US011577892B2

(12) United States Patent
Wong et al.

(10) Patent No.: US 11,577,892 B2
(45) Date of Patent: Feb. 14, 2023

(54) LID ASSEMBLY WITH A ROTARY TRIGGER FOR SEAL ASSEMBLY AND BEVERAGE CONTAINER COMPRISING THE SAME

(71) Applicant: KING'S FLAIR DEVELOPMENT LTD., Hong Kong (HK)

(72) Inventors: Siu Wah Wong, Hong Kong (HK); Chi Yeung Chan, Hong Kong (HK); Fat Sun Kwok, Hong Kong (HK); Shun Sang Poon, Hong Kong (HK); Chun Na Wong, Hong Kong (HK)

(73) Assignee: KING'S FLAIR DEVELOPMENT LTD., Hong Kong (HK)

( * ) Notice: Subject to any disclaimer, the term of this patent is extended or adjusted under 35 U.S.C. 154(b) by 0 days.

(21) Appl. No.: 17/318,228

(22) Filed: May 12, 2021

(65) Prior Publication Data

US 2021/0354888 A1 Nov. 18, 2021

Related U.S. Application Data

(60) Provisional application No. 63/148,218, filed on Feb. 11, 2021, provisional application No. 63/024,237, filed on May 13, 2020.

(51) Int. Cl.

| | |
|---|---|
| ***B65D 47/20*** | (2006.01) |
| ***B65D 47/26*** | (2006.01) |
| ***B65D 47/06*** | (2006.01) |

(52) U.S. Cl.

CPC ..... *B65D 47/265* (2013.01); *B65D 47/061* (2013.01); *B65D 2205/02* (2013.01); *B65D 2547/066* (2013.01)

(58) Field of Classification Search

CPC ..... A47G 19/2266; A47G 19/2272; B65D 47/061; B65D 47/265; B65D 47/2043; B65D 2205/02; B65D 2547/066; B65D 2543/00046; B65D 2543/00092

USPC ..... 220/253, 705, 707, 708, 709

See application file for complete search history.

(56) References Cited

U.S. PATENT DOCUMENTS

| | | | | | |
|---|---|---|---|---|---|
| 3,337,098 | A * | 8/1967 | Johns | B65D 47/2043 | 251/9 |
| 5,150,815 | A * | 9/1992 | Saklad | B65D 77/283 | 215/229 |
| 5,265,757 | A * | 11/1993 | Wu | A61J 9/006 | 220/709 |
| 5,337,918 | A * | 8/1994 | Wang | A47G 19/2266 | 222/536 |
| 5,361,934 | A * | 11/1994 | Spence, Jr. | B65D 47/2043 | 220/709 |
| 5,582,320 | A * | 12/1996 | Lin | B65D 47/2043 | 215/229 |
| 5,897,013 | A * | 4/1999 | Manganiello | B65D 77/283 | 220/252 |
| 6,626,314 | B1 * | 9/2003 | McHenry | B65D 47/265 | 220/255 |

(Continued)

*Primary Examiner* — Charles P. Cheyney
(74) *Attorney, Agent, or Firm* — WPAT, PC

(57) ABSTRACT

The present invention provides a lid assembly with a rotary trigger mechanism in combination with a seal assembly useful for actuating to open or close drink orifices and/or gas vent and is also able to selectively open the type of drink orifice as desirable. The invention also relates to a beverage container comprising such a lid assembly.

22 Claims, 26 Drawing Sheets

(56) References Cited

U.S. PATENT DOCUMENTS

| | | | | |
|---|---|---|---|---|
| 8,328,044 | B1 * | 12/2012 | Iskandar | A47G 19/2272<br>220/254.3 |
| 9,061,813 | B2 * | 6/2015 | Steininger | B65D 47/2043 |
| 9,314,120 | B2 * | 4/2016 | Kemper | A47G 19/2266 |
| 9,872,587 | B1 * | 1/2018 | DiPaolo | A47J 41/0055 |
| 10,512,347 | B1 * | 12/2019 | Shepard | B65D 47/066 |
| 2005/0006386 | A1 * | 1/2005 | Ronn | B65D 47/265<br>220/253 |
| 2011/0049169 | A1 * | 3/2011 | Rosnak | B65D 51/1672<br>220/361 |
| 2016/0198878 | A1 * | 7/2016 | Gilbert | B65D 43/02<br>220/262 |
| 2020/0339314 | A1 * | 10/2020 | Meyers | A47G 19/2272 |

* cited by examiner

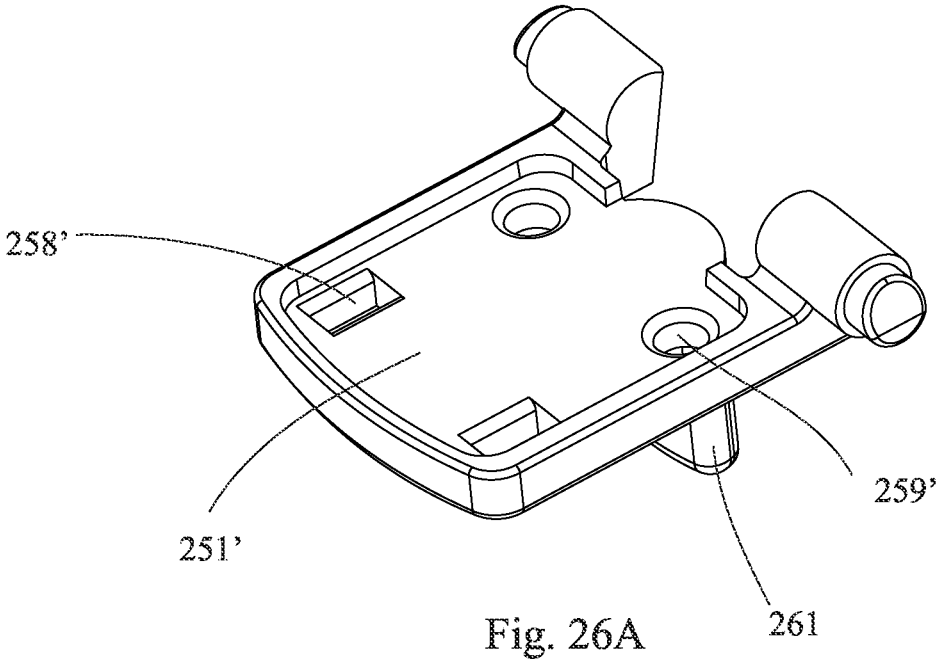
Fig. 26A
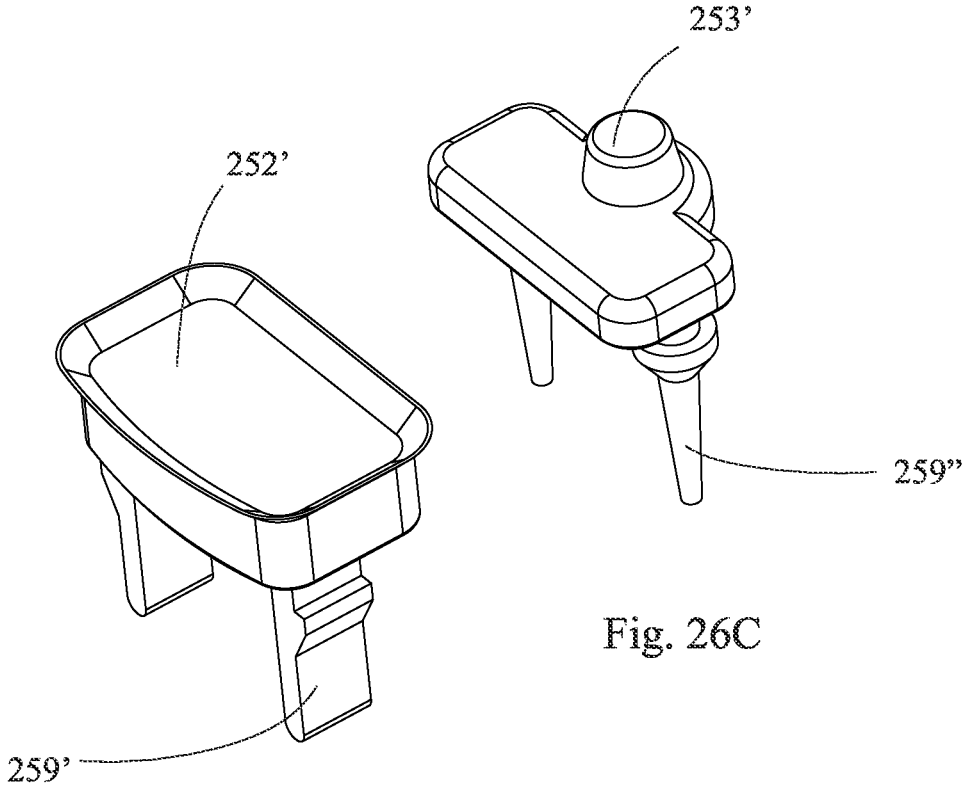
Fig. 26C
Fig. 26B

LID ASSEMBLY WITH A ROTARY TRIGGER FOR SEAL ASSEMBLY AND BEVERAGE CONTAINER COMPRISING THE SAME

RELATED APPLICATION

This non-provisional application claims priority from provisional application No. 63/024,237 filed on May 13, 2020 and provisional application No. 63/148,218 filed on Feb. 11, 2021, the disclosures of which are incorporated herein by reference in their entirety.

FIELD OF THE INVENTION

The present invention relates generally to the field of lids for containers, and more particularly, to a lid assembly with a rotary trigger mechanism useful for actuating a seal assembly to open and close drink orifices and/or gas vent. The invention also relates to a beverage container comprising such a lid assembly.

BACKGROUND OF THE INVENTION

Various types of beverage containers are currently available for on-the-go use. These containers are usually comprised of a lid secured to a container body, the lid having a drink orifice through which the beverage is dispensed. The lids come in a variety of configurations. In some configurations, the lids include an open spout or a sippy spout; in other configurations, the lids include a straw which extends through an orifice defined in the lids, allowing the straw to extend outwardly from the lids in one position and to be folded down in another position. However, the lids useful for the beverage containers do not provide a user with the flexibility of selecting one of multiple ways of dispensing the beverage.

Therefore, there is a need for a lid intended for a beverage container that is able to allow the user for selectively opening and closing one of a plurality of drink orifices for dispensing the beverage in different ways, and the lid provides easy access to the beverage of the beverage container while still being capable of preventing spillage out of the drink orifices.

SUMMARY OF THE INVENTION

The present invention has been developed to fulfill the needs noted above. Therefore, the present invention has a principal object of providing a lid assembly which provides an easy and convenient way to dispense in various ways the beverage stored in the container on-the-go.

A further object of the invention is to provide a lid assembly which has a simple trigger mechanism for selectively opening and closing a desirable one of a plurality of orifices of the lid assembly while still being capable of preventing spillage out of the orifices.

These and other objects are satisfied by the present invention, which provides a lid assembly for a beverage container, the lid assembly may comprise:

- a lid comprising
  - a lid cover at least having a first drink orifice and a second drink orifice extending therethrough, and
  - a side wall extending downwardly from the lid cover, and
- a trigger mechanism for selectively opening and closing the first and second orifices, comprising

- a top plate rotatably placed on the lid cover and having a cutout, and
- a trigger which is operably coupled to the top plate to cause the top plate to rotate about a longitudinal axis of the lid at least among a first position where the cutout of the top plate aligns with the first drink orifice to expose the first drink orifice and the second drink orifice is closed by the top plate, a second position where the cutout of the top plate aligns with the second drink orifice to expose the second drink orifice and the first drink orifice is closed by the top plate, and a third position where the cutout of the top plate misaligns with both the first and second drink orifices to close the two drink orifices.

In one embodiment of the present invention, the top plate may include a recessed portion formed in a top surface thereof and positioned contiguous to the second drink orifice, the recessed portion being adapted to receive a top segment of a foldable drinking straw which passes through the second drink orifice, the top segment being constrained by the top plate to lie in the recessed portion when the top plate is in the second and third positions, and caused to elastically folds upwards when the top plate is in the first position.

In some cases, the lid cover may further define a gas vent in a sloping portion configured to slope downwards to the first drink orifice, and a central through hole, the gas vent and the central through hole being in alignment with the first drink orifice along a diametric axis of the lid cover; or the lid cover further defines a gas vent in fluid communication with the external environment through an airway defined in the lid cover. The top plate may comprise a rotary shaft extending downwardly from an underside of the top plate, through which the top plate is rotatably mounted on the lid cover, and the rotary shaft is terminated by two spaced-apart press-fit legs.

In one embodiment of the present invention, the trigger mechanism may further comprise a bushing. A seal assembly is provided in the lid assembly and has an arm extending laterally from the bushing, a drink seal and a vent seal carried on the arm to respectively sealably close the first drink orifice and the gas vent. The press-fit legs are adapted for insertion into the bushing to press against an inner wall of the bushing to create a secure connection therebetween, so that the bushing with the seal assembly is driven to rotate by rotating the top plate. First and second rotation stoppers may be formed at an angular distance on a bottom surface of the lid cover to limit an angle of the rotation of the arm of the seal assembly, and the first and second rotation stoppers correspond to the first and second positions of the top plate.

Preferably, a fan-shaped boss may be formed on the bottom surface of the lid cover between the first and second rotation stoppers and positioned to underlie the first drink orifice and the gas vent. A projection may be formed on the side wall of the lid and positioned vertically in correspondence with the boss. The drink seal and the vent seal are caused to biased against the lid cover to sealably engage with the second drink orifice and the gas vent respectively when the lateral arm is rotated to be held between the boss and the projection.

In one embodiment of the present invention, the bushing may further comprise a pin post formed on an opposite side of the bushing to the lateral arm, and a tab is formed on the bottom surface of the lid cover and located in a rotation path of the pin post so as to limit the pin post to rotate when the lateral arm is rotated to be held between the boss and the projection, and application of force is required to enable the pin post to override the tab, thereby allowing the bushing to rotate.

In an alternative embodiment of the present invention, the trigger assembly may further comprise a guide arrangement which includes a bushing and a guide rail extending transversely from the bushing. The lid assembly further comprises a seal assembly comprising a pivotal arm pivotally mounted on the lid cover, and a drink seal and a vent seal which are either carried on the pivotal arm or carried on a seal holder provided on an outer side wall of the bushing to respectively close the first drink orifice and the gas vent. The press-fit legs are adapted for insertion into the bushing to press against an inner wall of the bushing to create a secure connection therebetween, so that the bushing with the seal assembly is driven to rotate by rotating the top plate.

The guide rail may be preferably configured to have a cross section in the form of a letter U having a distal side branch located away from the bushing and a proximal side branch proximate to the bushing. The seal assembly further comprises a guide pin extending downwardly from the pivotal arm and positioned to enter and be received in the guide rail. The guide pin cooperates with the guide rail to actuate the pivotal arm to pivot upwardly and downwardly with respect to the lid cover to close or open the first drink orifice and/or the gas vent. The distal side branch of the guide rail has an inner wall surface that forms a guiding surface, and the guide pin has an outer side wall facing toward the guiding surface. The guide pin is received in the guide rail in such a manner that, during rotation of the guide rail, the outer side wall of the guide pin is alternately unconstrained to the guiding surface of the guide rail, and in abutment with the guiding surface of the guide rail, thereby to actuate the upward and downward pivotal movement of the pivotal arm.

In one specific embodiment of the present invention, the guide rail may be configured to have a substantially arcuate shape extending from a first end to a second end, and the guide rail has a constant guide width over an entire length from the first end to the second end, with one or more protrusions formed on the guiding surface, so that the outer side wall of the guide pin located within the guide rail sets against the protrusion, thereby the guide pin is pressed inwardly by the guiding surface to pivot the pivotal arm downwardly. Preferably, the protrusion extends laterally from the guiding surface of the guide rail, with the lateral extension of gradually reduced dimension along the perimetric direction of the distal side branch, so as to provide the guide rail with a guide width of gradually increased along with said lateral extension of gradually reduced dimension.

Alternatively, the guide rail may be configured to have a substantially arcuate shape extending from a first end to a second end, and the guide rail has a gradually variable guide width over an entire length from the first end to the second end in one or more designated segments of the guide rail, so that the outer side wall of the guide pin located within the guide rail sets against the guiding surface of the guide rail at positions of reduced rail width, thereby the guide pin is pressed inwardly by the guiding surface to pivot the pivotal arm downwardly. The pivotal arm may have a proximal end pivotally mounted on the lid cover through two stubs extending from opposite sides of the proximal end, and a distal end. A torsion spring may be held on each of the stubs to constantly apply an upward pressure to the pivotal arm.

In some cases, the pivotal arm may further include one or more slots arranged between the proximal end and the distal end. The drink seal and the vent seal are provided with one or more inserts positioned for snug insertion into the slots of the pivotal arm and being fixed in place, so that the drink seal and the vent seal can move pivotally along with the pivotal movement of the pivotal arm.

In one embodiment of the present invention, the guide rail may comprise a tab, the tab being limited to rotate by a tip portion of the guide pin when the seal assembly is in place to sealably close the lid cover, and application of force is required to enable the tab to override the tip portion of the guide pin, thereby allowing the guide rail to rotate.

In one embodiment of the present invention, the lid cover may be configured to have an annular raised rim that encircles the lid cover, and the trigger is provided as a handle projecting from an upper surface of the top plate and rotatably fitting onto the raised rim of the lid cover, so that turning the handle drives the top plate to move among the first, second and third positions.

In another embodiment of the present invention, a bulge may be formed on a wall surface of the drinking straw, the rotary top plate is thus required to override the bulge to overlie the drinking straw during the rotation of the rotary top plate to close the second drink orifice.

Another aspect of the present invention provides a beverage container comprising a container body including an open-top wall structure defining a receptacle for receiving beverage, and a lid assembly of the present invention detachably secured on top of the container body.

BRIEF DESCRIPTION OF THE DRAWING

To have a better understanding of the invention reference is made to the following detailed description of the invention and embodiments thereof in conjunction with the accompanying drawings. In the various figures of the drawings, like reference numbers are used to designate like parts.

FIGS. 26 A to 26C are perspective views of a variation of the seal assembly.

DETAILED DESCRIPTION OF THE INVENTION

Figure 1:
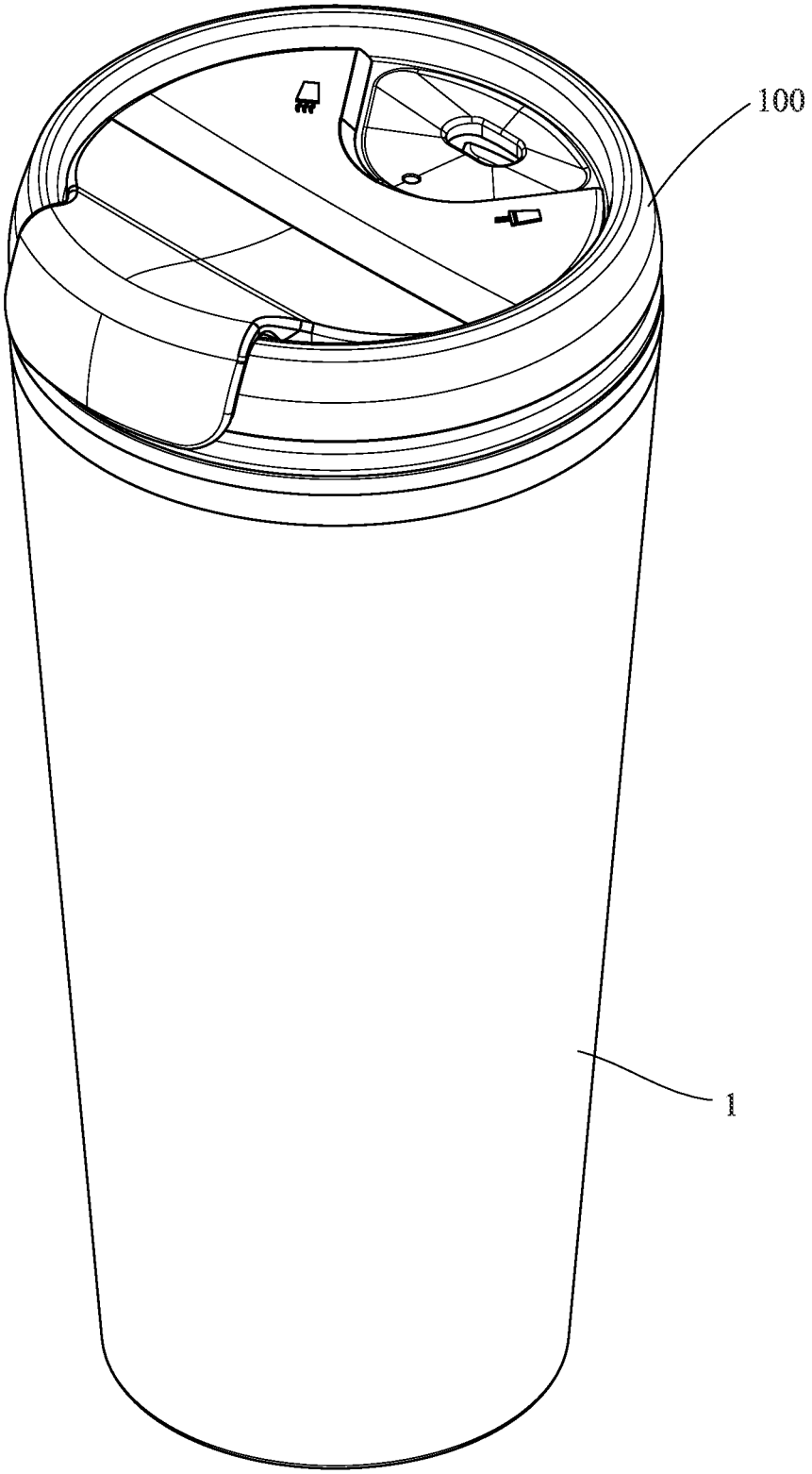
FIG. 1 is a perspective view of an exemplary travel beverage mug having a lid assembly constructed according to a first embodiment of the present invention, wherein a first drink orifice is open, and a second drink orifice is closed.

While the present invention is illustrated and described in preferred embodiments, the lid assembly of the present invention may be produced in many different configurations, sizes, forms and materials for dispensing beverage in a beverage container.

According to the invention, the lid assembly is adapted for a travel beverage container, the lid assembly having a trigger mechanism configured for selectively opening one or more of a plurality of orifices of the travel beverage container and also for sealably closing the orifices. The trigger mechanism allows to rotate the lid among a plurality of positions and also allows for gas venting before the drink orifices are open for beverage dispensing during the rotation of the lid.

Referring now to the drawings, FIGS. 1 to 10 illustrate an exemplary lid assembly 100 constructed consistent with a first embodiment of the invention and adapted for a travel beverage mug 1. The beverage mug 1 can be of any type shape used to hold cold or hot water, soft drinks or other beverages for consumption. The lid assembly 100 is engaged with the beverage mug through thread mating or in snap-fit manner. As illustrated, the lid assembly 100 comprises a lid 110, a trigger mechanism 130 and a seal assembly 150.

The lid 110 comprises a lid cover 111 and a side wall 112 extending downwardly from the lid cover 111. The lid cover 111 may define two or more orifices which may have a same size as or a different size from one another. The side wall 112 is adapted to be coupled to the beverage mug, for example through threading engagement. As illustrated, the lid cover 111 and the side wall 112 together define a lid body of substantially cylindrical structure. The lid body is sized and configured to close an opening of the beverage mug 1, and can be detachably secured on the top of the beverage mug 1.

Figure 3A:
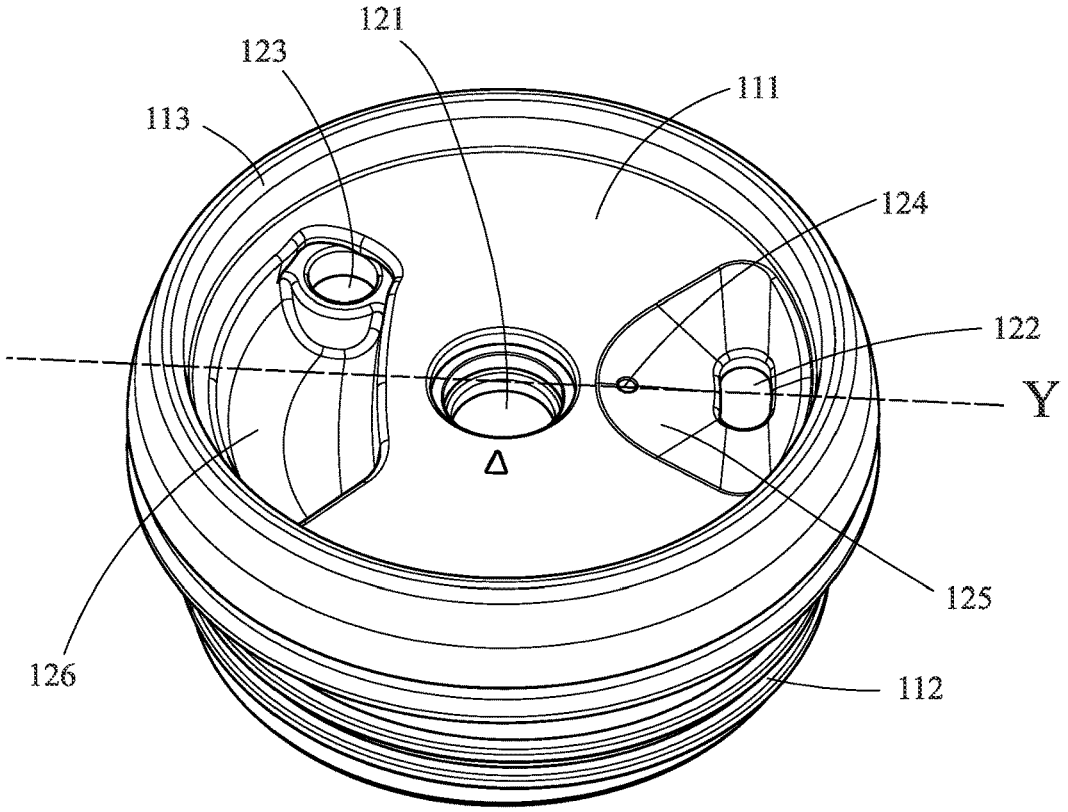
FIGS. 3A and 3B are top and bottom perspective views of a lid cover of the lid assembly, respectively.
Figure 3B:
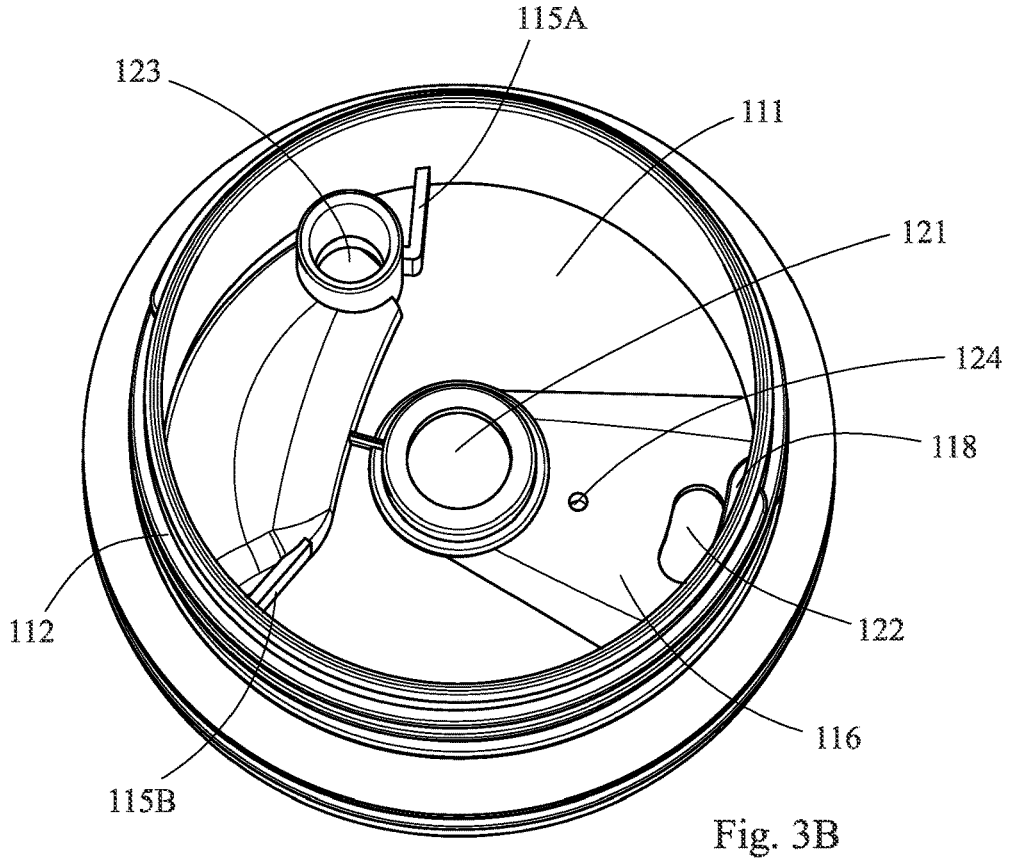

FIGS. 3A and 3B illustrate a top view and a bottom view of the lid cover 111, respectively. As illustrated, the lid cover 111 has an annular raised rim 113 that encircles the lid cover 111. The lid cover 111 defines a central through hole 121, a first drink orifice 122, a second drink orifice 123 and a gas vent 124. The first drink orifice 122 and the second drink orifice 123 are of different dimensions and shapes to cater for different beverage consumption needs. For example, the first drink orifice 122 is shaped and sized to be an elongated slot for direct consumption of the beverage by the user, whereas the second drink orifice 123 is shaped and sized to be a circular hole for insertion of a drinking straw 114. The first drink orifice 122 and the second drink orifice 123 are spaced apart circumferentially and may be positioned adjacent to the raised rim 113 of the lid cover 111 and in fluid communication with the interior of the beverage mug 1. As shown in FIG. 3A, the first drink orifice 122 and the second drink orifice 123 are formed and arranged substantially on two sides of the central through hole 121.

The lid cover 111 includes a sloping portion 125 on a top surface thereof, and the sloping portion 125 is configured to slope downward to the first drink orifice 122. The gas vent 124 is in alignment with the first drink orifice 122 and the central through hole 121 along a diametric axis Y, and is located in the sloping portion 125 between the first drink orifice 122 and the central through hole 121. The top surface of the lid cover 111 also includes a recessed portion 126 contiguous to the second drink orifice 123, and the recessed portion 126 is sized and shaped for accommodating completely a top segment of the drinking straw 16 that protrudes beyond the second drink orifice 123, when the top segment is folded downwards to the lid cover 111.

Turning to FIG. 3B, the lid cover 111 further includes first and second rotation stoppers 115A, 115B at an angular distance on a bottom surface of the lid cover 111. The first and second rotation stoppers 115A, 115B are located adjacent to two ends of the recessed portion 126. A fan-shaped boss 116 is formed on the bottom surface of the lid cover between the first and second rotation stoppers 115A, 115B. The boss 116 is positioned to underlie the second drink orifice 122 and the gas vent 124. A tab 117 is arranged on the bottom surface of the lid cover 111, opposite to the boss 116 with respect to the central through hole 121 of the lid cover 111. A projection 118 is formed on the side wall 112 of the lid 110 and positioned immediately below the boss 116.

Figure 2A:
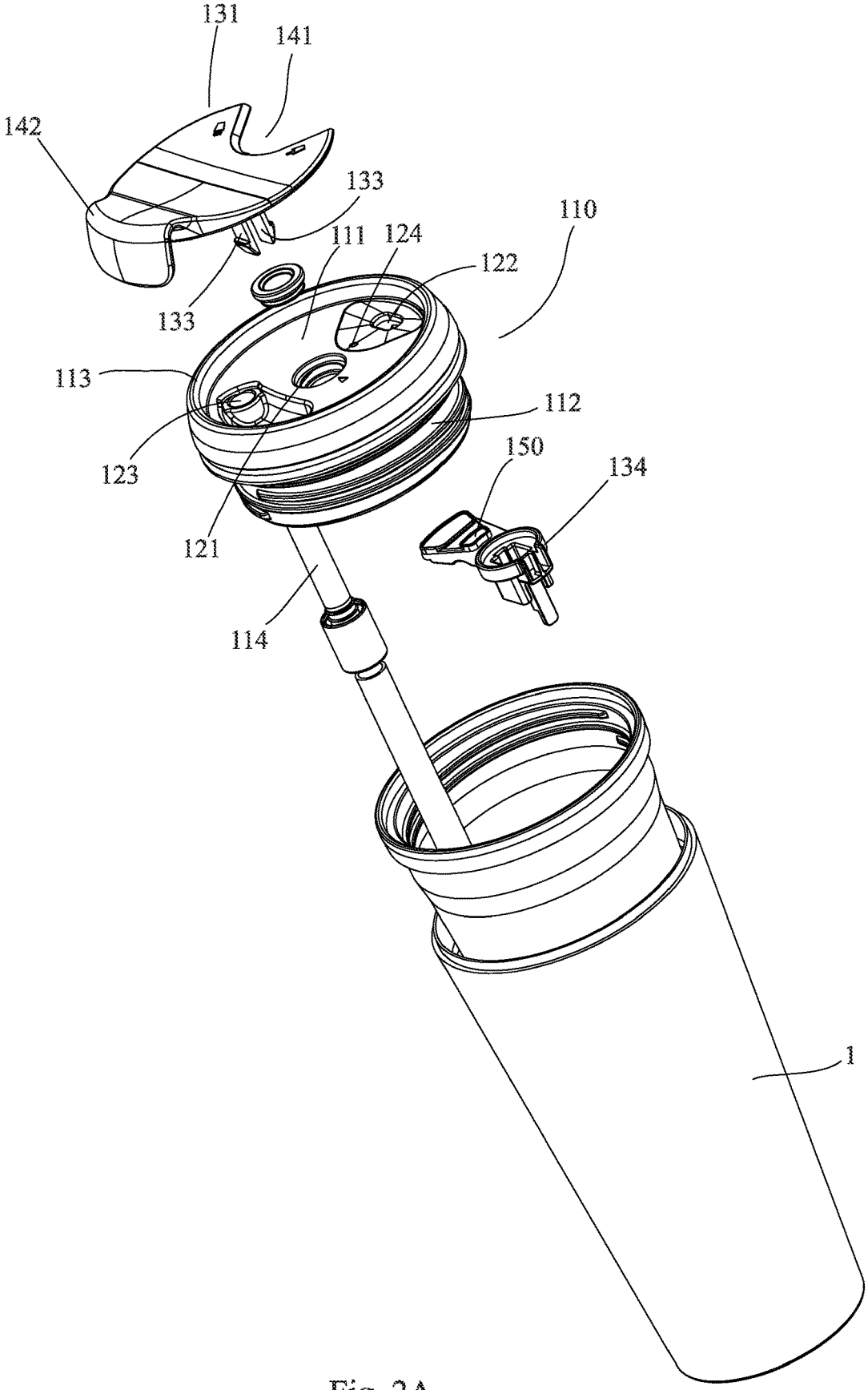
FIGS. 2A and 2B are perspective exploded views of the beverage mug shown in FIG. 1 in two different angles of view.
Figure 2B:
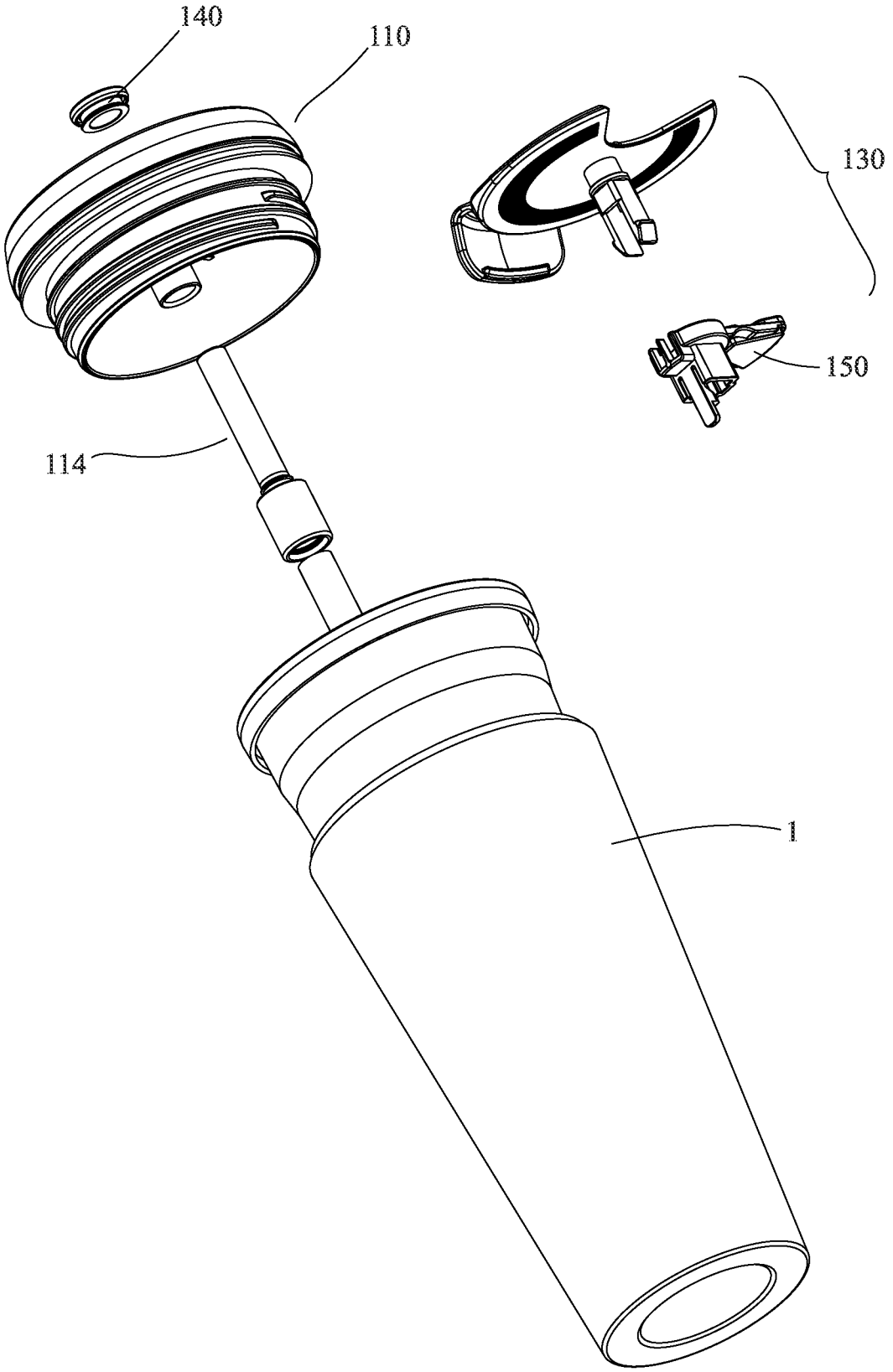
Figure 4:
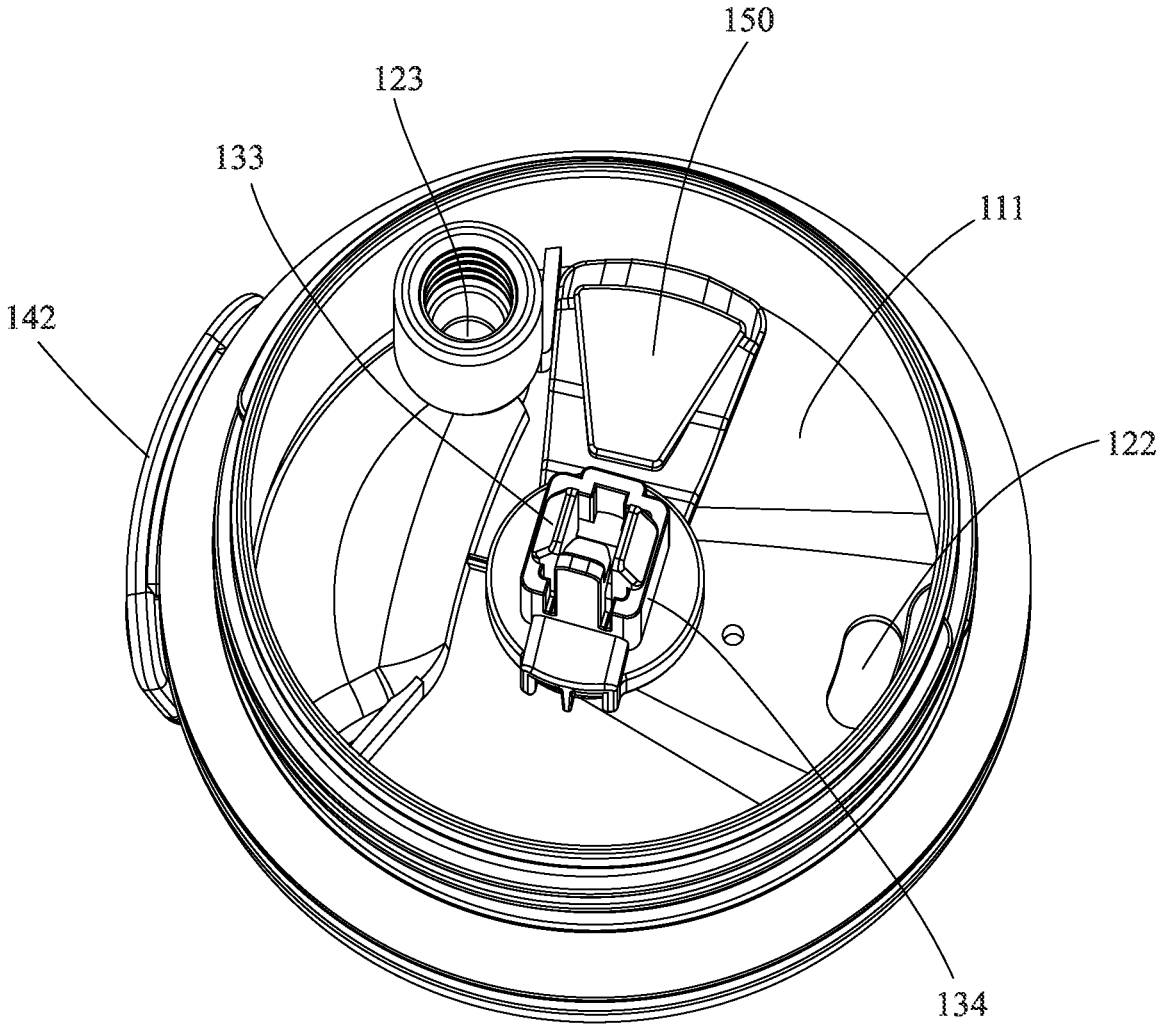
FIG. 4 is a perspective bottom view of the lid cover with the trigger mechanism and the seal assembly shown in FIG. 1.
Figure 5A:
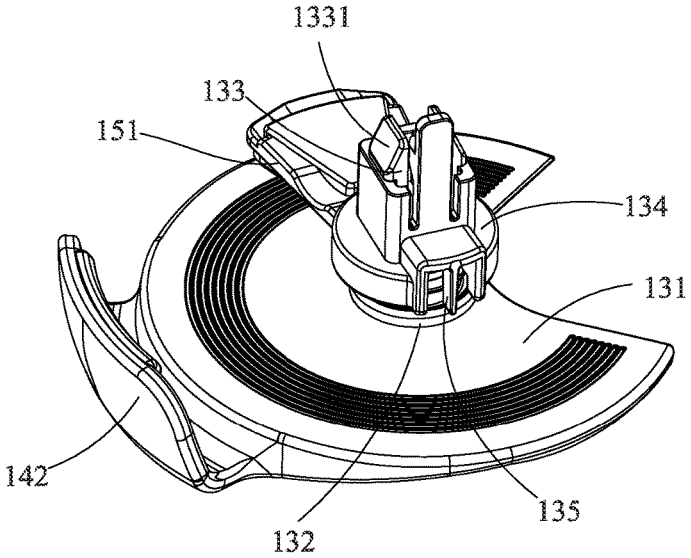
FIGS. 5A and 5B show the trigger mechanism with the seal assembly shown in FIG. 4 in different perspective views.
Figure 5B:
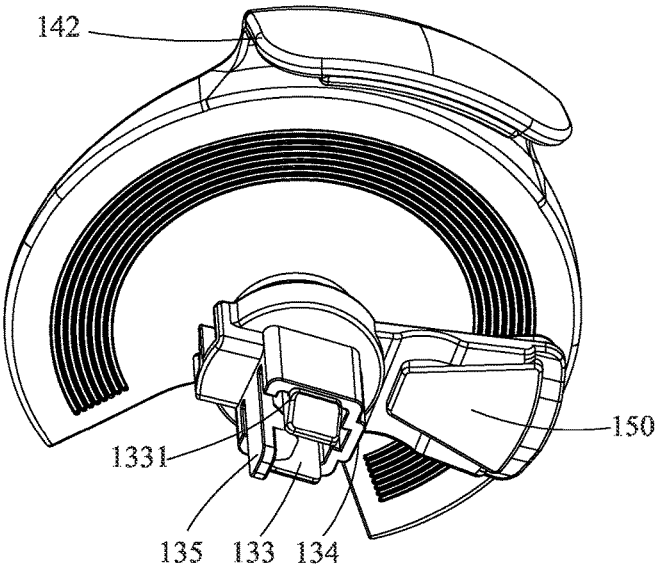

As shown in FIG. 4 and FIGS. 5A and 5B further with reference to FIGS. 2A and 2B, the trigger mechanism 130 is rotatably mounted on the lid cover 111, and comprises a rotary top plate 131, a rotary shaft 132 integral with the top plate 131 and extending downwardly from an underside of the top plate, two spaced-apart press-fit legs 133 extending downwardly from end face of the rotary shaft 132 at a center thereof, and a bushing 134. The top plate 131 is configured to have a substantially V-shaped cutout 141, a handle 142 projecting from an upper surface of the top plate 131. The top plate 131 is placed on the lid cover 111 with the handle 142 rotatably fitting onto the raised rim 113 of the lid cover 111. The rotary shaft 132 is adapted for rotatably passing through the central through hole 121 of the lid cover 111, through which the top plate 131 rotates relative to the lid cover 111. Each of the two press-fit legs 133 includes a stop portion 1331 at its free end. The two press-fit legs 133 are insertable into the bushing 134 and press against the inner wall of the bushing 134 so that the press-fit legs 133 are secured to the bushing 134. The stop portions 1331 of the press-fit legs 32 are located exterior of the bushing 33 and are in abutment with a bottom end face of the bushing 33 in order to enhance the coupling therebetween. A collar 140 is provided to encase the rotary shaft 132 and arranged snugly within the central through hole 121 of the lid cover 111 to reinforce the mechanical strength and rotation of the top plate 131. Because the press-fit legs 133 are secured to the bushing 134, turning the handle 142 of the top plate 131 would drive the bushing 134 to rotate at the same time.

The bushing 134 further comprises a pin post 135, and the tab 117 formed on the bottom surface of the lid cover 111 is located in a rotation path of the pin post 135, so that a slightly greater amount of force is required in order for the pin post 135 to override the tab 117 whenever it rotates to encounters the tab 117.

Figure 6:
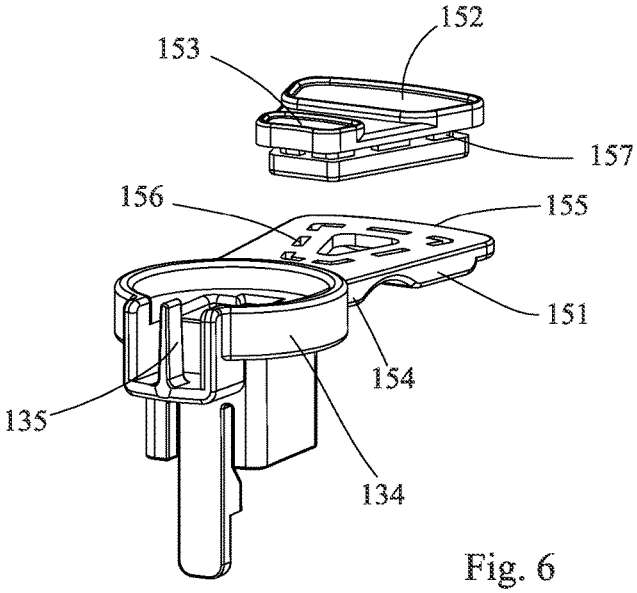
FIG. 6 is an exploded perspective view of a bushing of the trigger mechanism and the seal assembly.
Figure 7C:
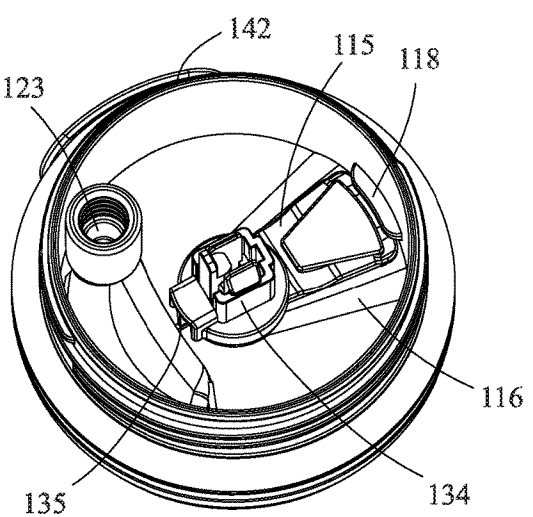
FIGS. 7A to 7C respectively show a top view, a bottom view and a perspective view of the lid assembly in a third fully closed position, where both the first and second drink orifices are fully closed.
Figure 7B:
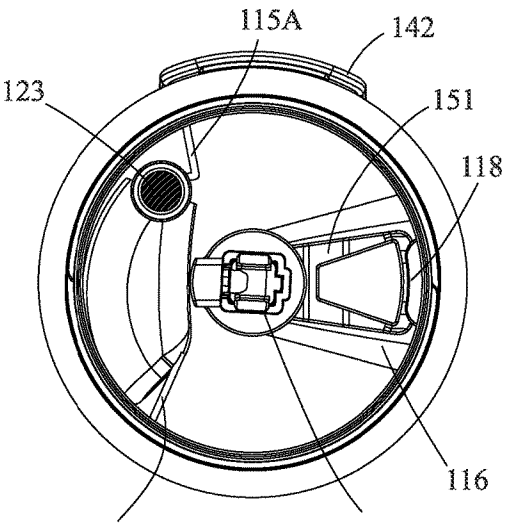
Figure 7A:
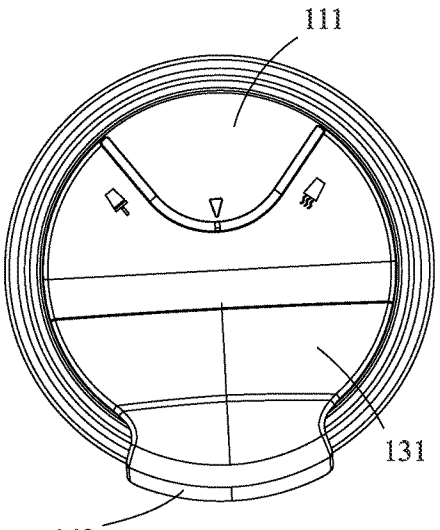

The seal assembly 150 is provided beneath the lid cover 111 of the lid 110. With reference to FIGS. 5A, 5B and 6, the seal assembly 150 is caused by the bushing 134 to be rotatable relative to the lid cover 111. In this embodiment, the seal assembly 150 comprises a rotatable arm 151 extending laterally from the bushing 134, and a seal member held on the rotatable arm 151. The seal member comprises a drink seal 152 and a vent seal 153 configured to respectively close the first drink orifice 122 and the gas vent 124. The drink seal 152 and the vent seal 153 are preferably made of rubber or silicon.

Specifically, the rotatable arm 151 has a proximal end 154, a distal end 155, and a plurality of slots 156 arranged between the proximal end 154 and the distal end 155 to be engageable with a plurality of studs 157 of the seal member for securing the seal member in place, so that the seal member can move rotatably along with the rotation of the rotatable arm 151.

The vent seal 153 in this embodiment is arranged contiguous to the proximal end 154 of the rotatable arm 151. The vent seal 153 is positioned and configured to be engageable sealably with the gas vent 124. The drink seal 152 is positioned and configured for sealably blocking the first drink orifice 122 and formed integrally with the vent seal 153. The drink seal 152 is levelled different from the vent seal 153. This level difference between the two seals ensures to provide an enough venting space and also allows for better dispensing of the beverage from the mug 1 through the first drink orifice 122.

In an alternative embodiment of the invention, the drink seal and the vent seal may be provided separately, and secured to the rotatable arm respectively. In a yet alternative embodiment of the invention, the drink seal and the vent seal may be formed as one piece but are arranged at a same level for closing the first drink orifice 122 and the gas vent 124. These and other possible variations of the seal member would be within the ability of a person skilled in the art.

A seal ring (not shown) may be provided to snugly fit onto the side wall 113 of the lid 110 to create a seal against the beverage mug when the lid assembly 100 is engaged with the top of the beverage mug.

FIGS. 7A to 9D are schematic views of the top plate 131 in different positions. When the top plate 131 is in the third fully closed position, the cutout 141 of the rotary top plate 131 is misaligned with any of three of the first drink orifice 122, the second drink orifice 123 and the gas vent 124, so that all the three orifices are fully covered up by the rotary top plate 131, the beverage in the mug 1 cannot be dispensed, which is clearly shown in FIG. 7A. In this position, the first drink orifice 122 and the gas vent 124 are sealably closed by the drink seal 152 and the vent seal 153, respectively; and the top segment of the drinking straw 114 running through and protruding beyond the second drink orifice 123 is folded down to lie within the recessed portion 126. It can be seen in FIGS. 7B and 7C, in this fully closed position, the rotatable arm 151 is held tightly between the fan-shaped boss 116 formed on the bottom surface of the lid cover 111 and the projection 118 formed on the side wall 112 so that the drink seal 152 and the vent seal 153 are pressed to bias against the lid cover 111 for increased sealability of the first drink orifice 122 and the gas vent 124.

Figure 10A:
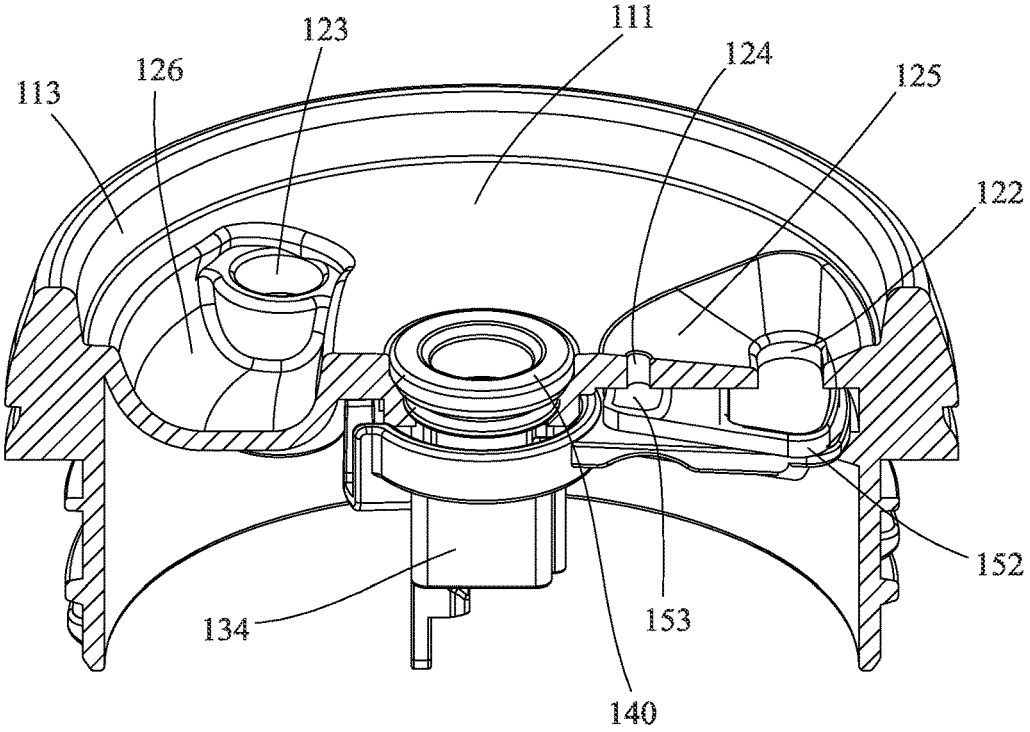
FIGS. 10A and 10B are perspective top and bottom views of the lid assembly in the third fully closed position, respectively taken along a line of diametric axis Y and a line of the tab formed on the bottom surface of the lid cover.
Figure 10B:
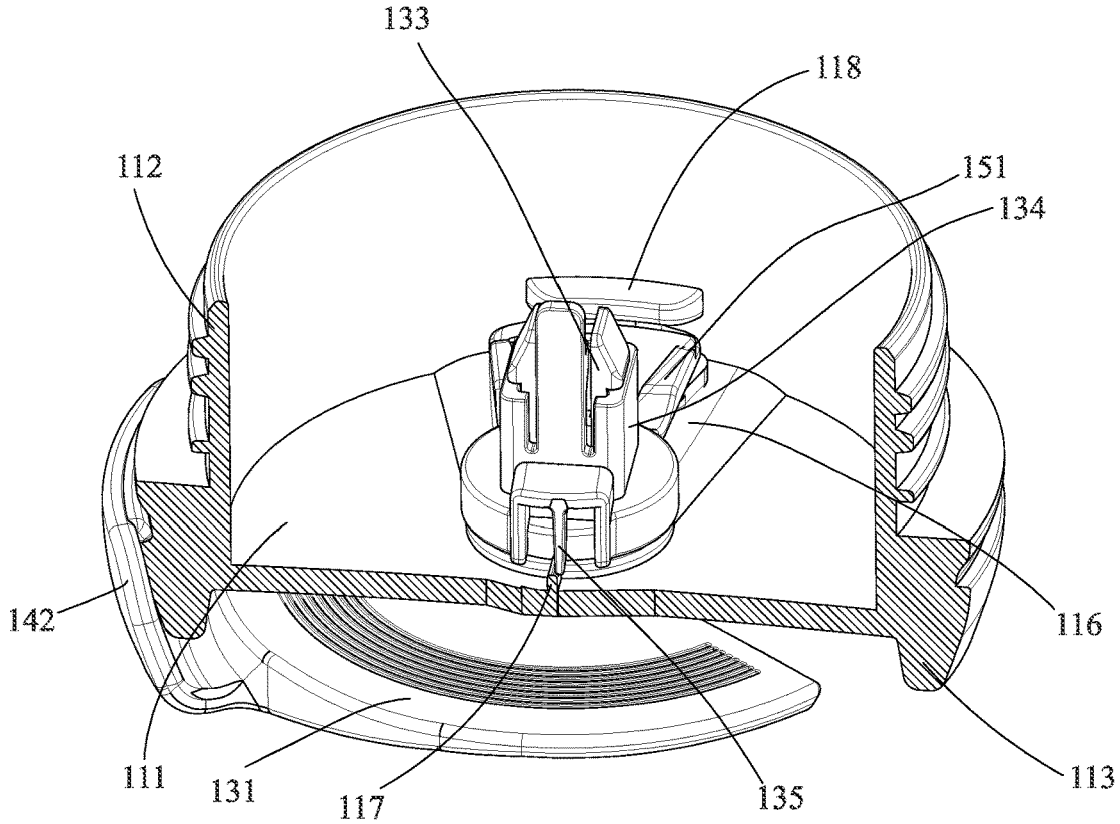
Figure 11:
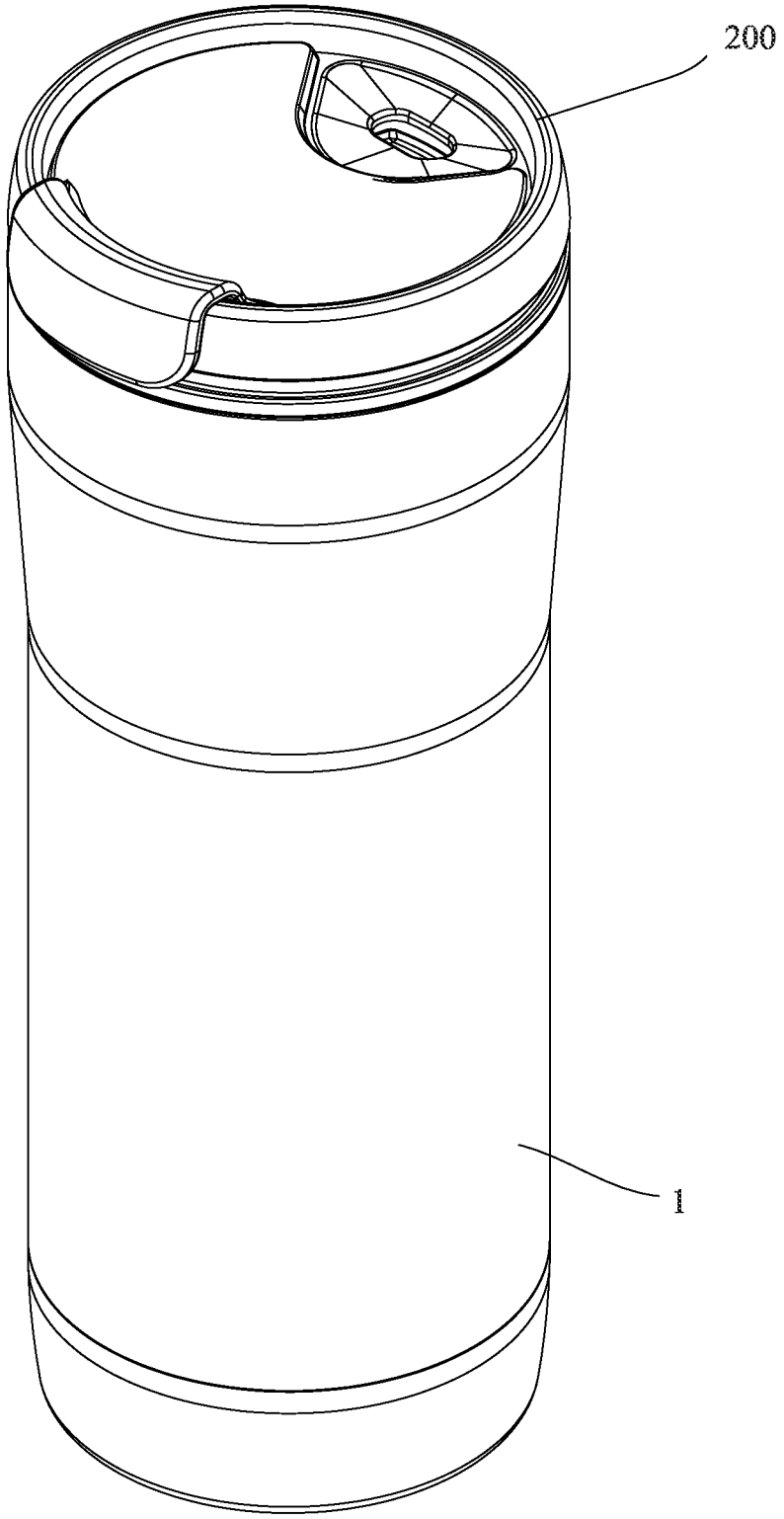
FIG. 11 is a perspective view of another exemplary travel beverage mug having a lid assembly constructed according to a second embodiment of the present invention, wherein a first drink orifice is open, and a second drink orifice is closed.

Now with reference to FIGS. 10A and 10B, the tab 117 on the bottom surface of the lid cover 111 is located in the rotation path of the pin post 135 of the bushing 134 (see FIG. 10B). The pin post 135 is in abutment with the tab 117 when the top plate 131 is in the third fully closed position, so that application of force on the handle 142 is required to enable the pin post 135 to override the tab 117, thereby allowing the bushing 134 and thus the rotatable arm 151 to rotate.

Figure 8C:
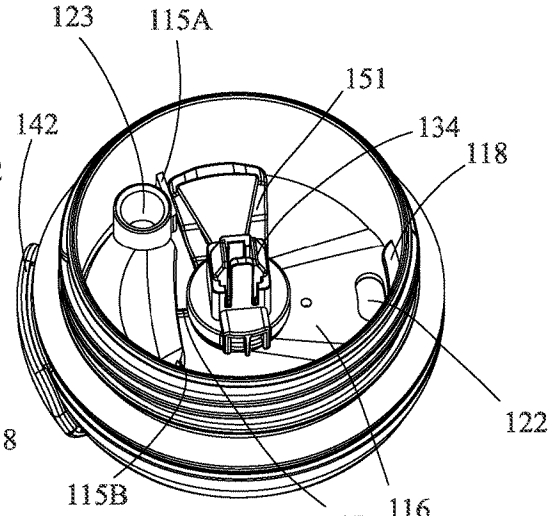
FIGS. 8A to 8C respectively show a top view, a bottom view and a perspective view of the lid assembly in a first dispensing position where the first drink orifice is in fully open position, and the second drink orifice is fully closed.
Figure 8B:
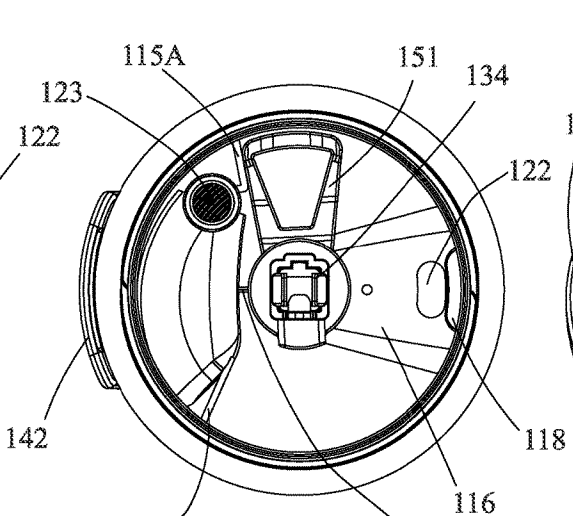
Figure 8A:
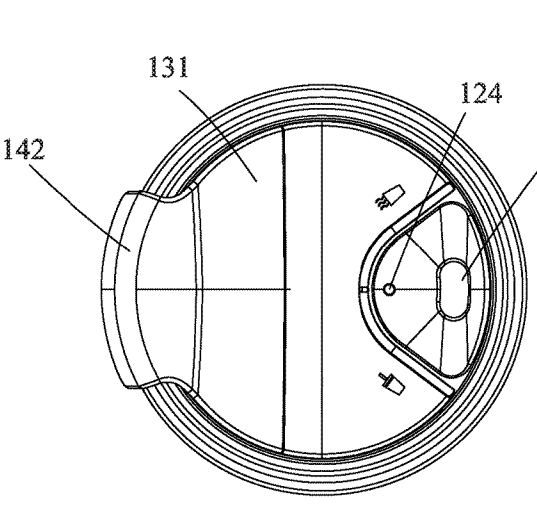

As described above, the rotary top plate 131 is rotatably placed on the lid cover 111 around the central longitudinal axis of the lid cover 111, and turning the handle 142 can drive the bushing 134 to simultaneously rotate about the central longitudinal axis of the lid cover 111, with the result of rotating the rotatable arm 151 carrying the seal member between the first and second rotation stoppers 115A and 115B. These two rotation stoppers are provided to limit an angle of rotation of the rotatable arm 151 and positioned to correspond to the first and second positions of the rotary top plate 131. Turning in a clockwise direction the top plate 131 in fully closed position can drive the clockwise rotation of the bushing 134 and thus the rotatable arm 151 carrying the seal member to move away from the gas vent 124 and the first drink orifice 122. With the rotational movement of the rotatable arm 151, the seal member moves further away from the gas vent 124 for the escape of gas in the mug 1 and also away from the first drink orifice 122, until the rotatable arm 151 is stopped by the first rotation stopper 115A as shown in FIGS. 8B and 8C, where the rotary top plate 131 is turned to its first fully open position, with the cutout 141 in alignment with the first drink orifice 122 but the drinking straw 114 still remaining to lie within the recessed portion 126 and being fully covered up by the top plate 131. In this first position, the first drink orifice 142 is fully open and in fluid communication with the beverage in the mug to allow for dispensing of the beverage therethrough.

Figure 9C:
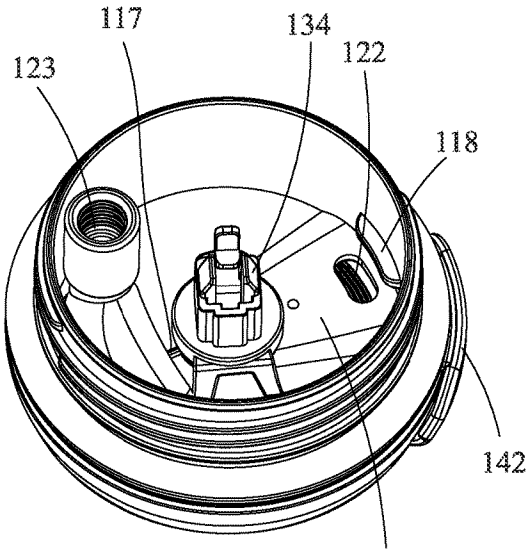
FIGS. 9A to 9D respectively show a top view, a bottom view and a perspective view of the lid assembly in a second dispensing position, where the second drink orifice is in fully open position with the drinking straw ready for dispensing the beverage, and the first drink orifice is fully closed.
Figure 9B:
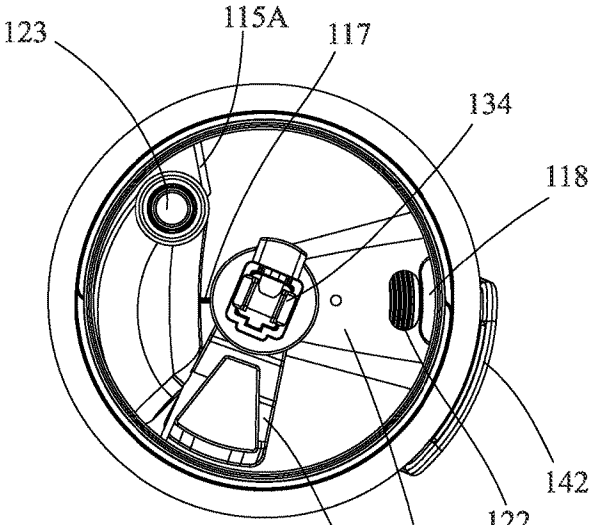
Figure 9D:
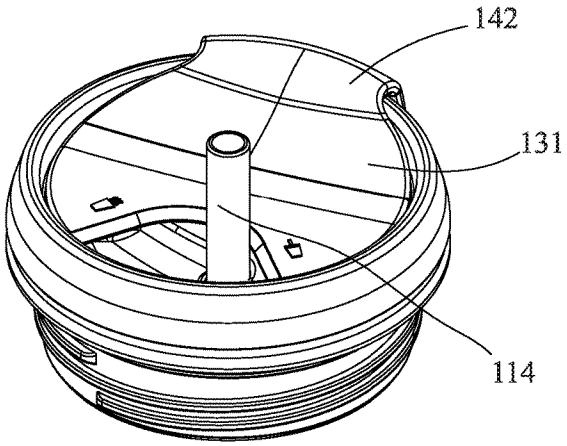
Figure 9A:
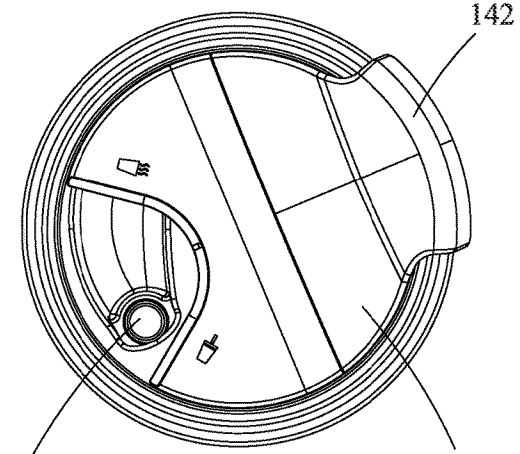

If it is desirable for dispensing the beverage though the drinking straw 114, turning in an anticlockwise direction the top plate 131 in fully closed position (i.e. in the position shown in FIGS. 7A to 7C) can drive the anticlockwise rotation of the bushing 134 and thus the rotatable arm 151. The cutout 141 rotates to partially overlie the recessed portion 126 of the lid cover 111 to have the drinking straw 114 be partially exposed. This partially exposed drinking straw is ready for fold upwardly due to its material elasticity. The rotary top plate 131 continues to rotate so that the rotatable arm 151 carrying the seal member is caused to rotate further, until the rotatable arm 151 is stopped by the second rotation stopper 115B as shown in FIGS. 9B and 9C, where the rotary top plate 131 is turned to its second fully open position, with the cutout 141 in alignment with the recessed portion 126 and the second drink orifice 123. The second drink orifice 123 is fully exposed, and the drinking straw 114 elastically folds upwards to an upstanding position. Therefore, in the second fully open position of the top plate 131, the first drink orifice 122 and the gas vent 124 are covered up by the top plate 131 (see FIG. 9A), but the second drink orifice 123 is fully open, and the drinking straw 114 running through the second drink orifice 123 is in the upstanding position to be in fluid communication with the beverage in the mug 1 to allow for dispensing of the beverage therethrough.

Now turning to FIGS. 11 to 23, there is illustrated an exemplary lid assembly 200 constructed consistent with a second embodiment of the invention and adapted for a travel beverage mug 2. The lid assembly 200 of this embodiment comprises a lid 210, a trigger mechanism 230 and a seal assembly 250, and is substantially structurally same as the one shown in the first embodiment above, except the trigger mechanism 230.

The lid 210 comprises a lid cover 211 and a side wall 212 extending downwardly from the lid cover 211. Similar to the above first embodiment, the lid cover 211 has an annular raised rim 213 that encircles the lid cover 212, and also defines a central through hole 221, a first drink orifice 222, a second drink orifice 223 and a gas vent 224. In this embodiment, the gas vent 224 is arranged on the same side of the second drink orifice 243 with respect to the central through hole 221.

The lid cover 211 includes a sloping portion 225 on a top surface thereof, and the sloping portion 225 is configured to slope downward to the first drink orifice 222. The top surface of the lid cover 211 also includes a recessed portion 226 contiguous to the second drink orifice 243, and the recessed portion 226 is sized and shaped for accommodating completely a top segment of the drinking straw 214 that protrudes beyond the second drink orifice 243, when the top segment is folded downwards to the lid cover 211. The gas vent 224 is in communication with the recessed portion 26 through a gas channel 227 connecting the gas vent 224 and the recessed portion 226.

Figure 14:
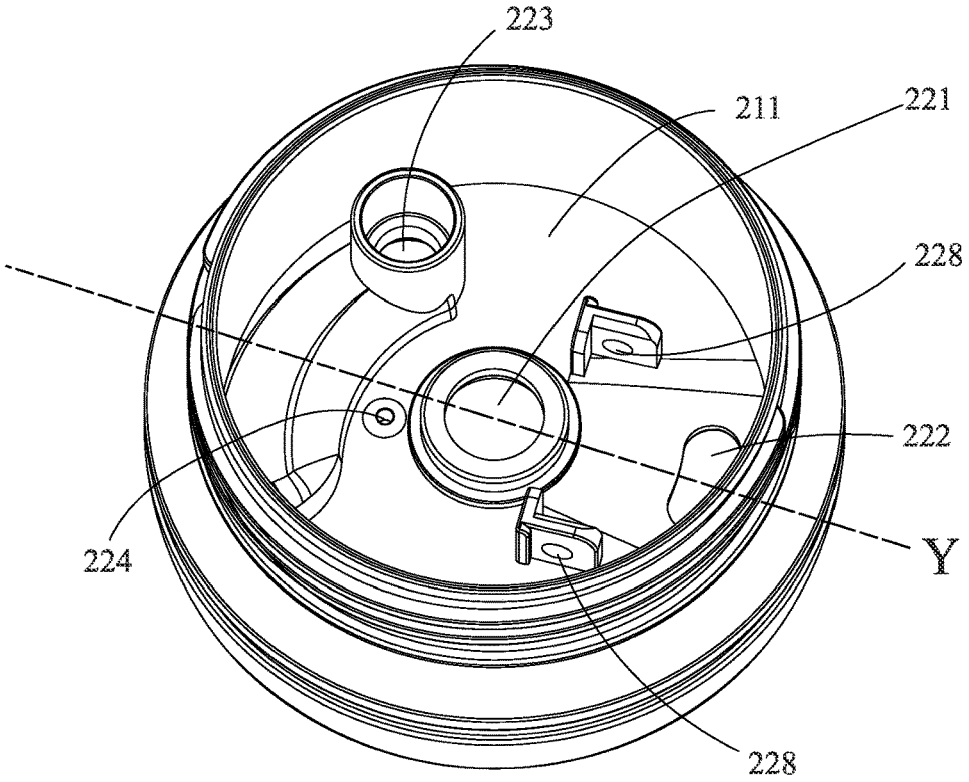
FIG. 14 is a perspective bottom view of the lid cover shown in FIG. 11.
Figure 15A:
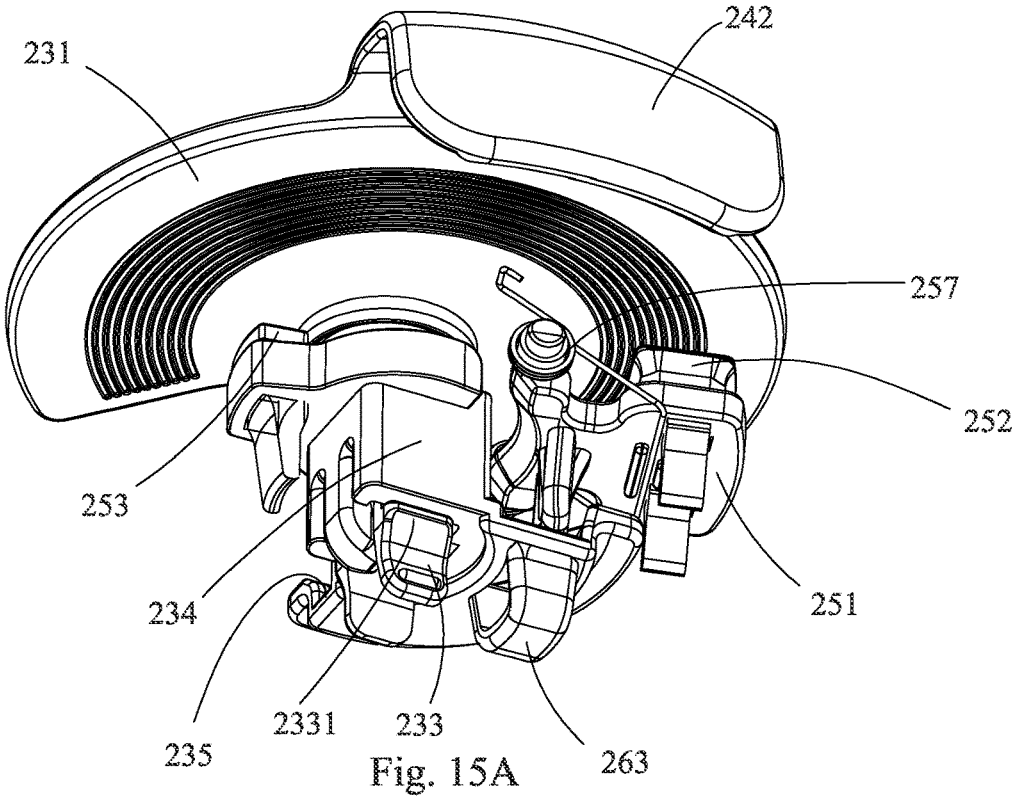
FIG. 15A is a perspective top view of the trigger mechanism with the seal assembly of the lid assembly shown in FIG. 11.
Figure 15B:
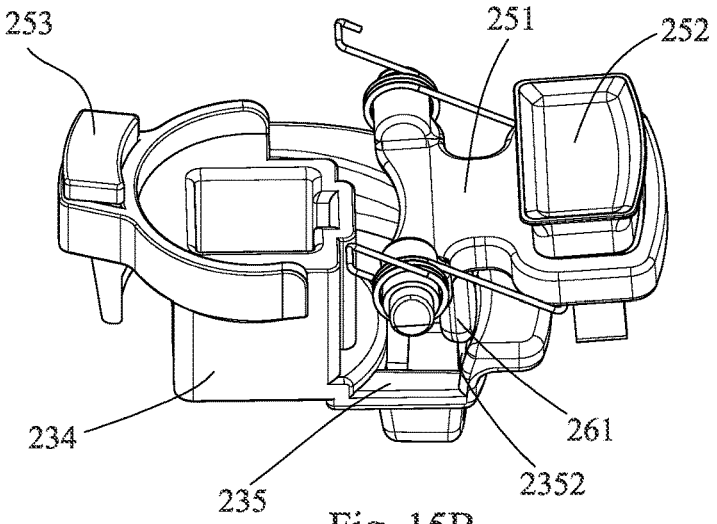
FIGS. 15B to 15D are respective perspective view of the trigger mechanism and the seal assembly shown in FIG. 15A, with the rotary top plate being removed.
Figure 15C:
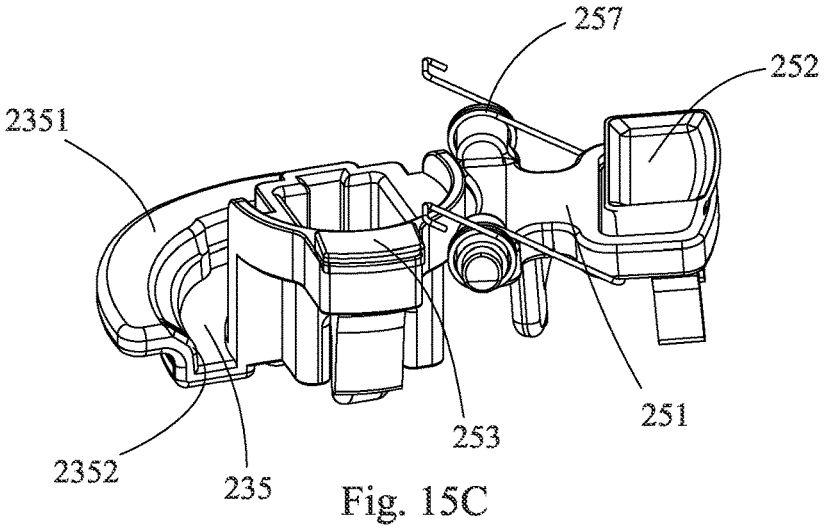
Figure 15D:
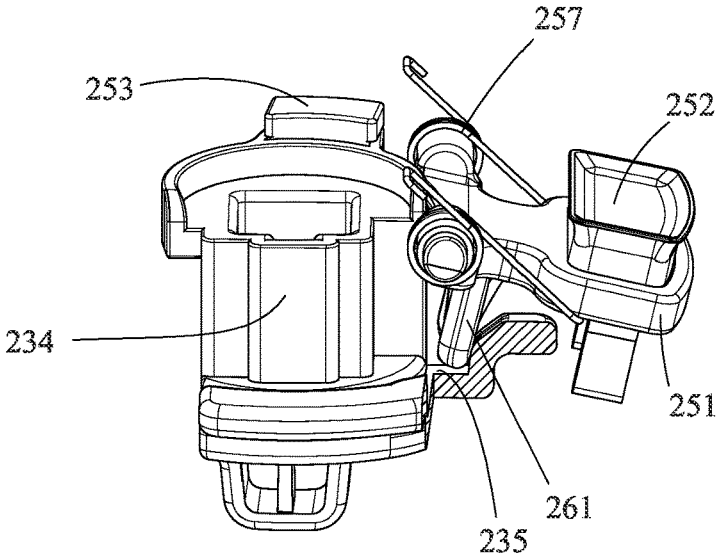

The lid cover 211 further includes two opposite pivots 228 on its bottom surface, which are arranged in a symmetrical manner around the diametric axis Y along which the first drink orifice 222 and the central through hole 221 are aligned (see FIG. 14).

Figure 12A:
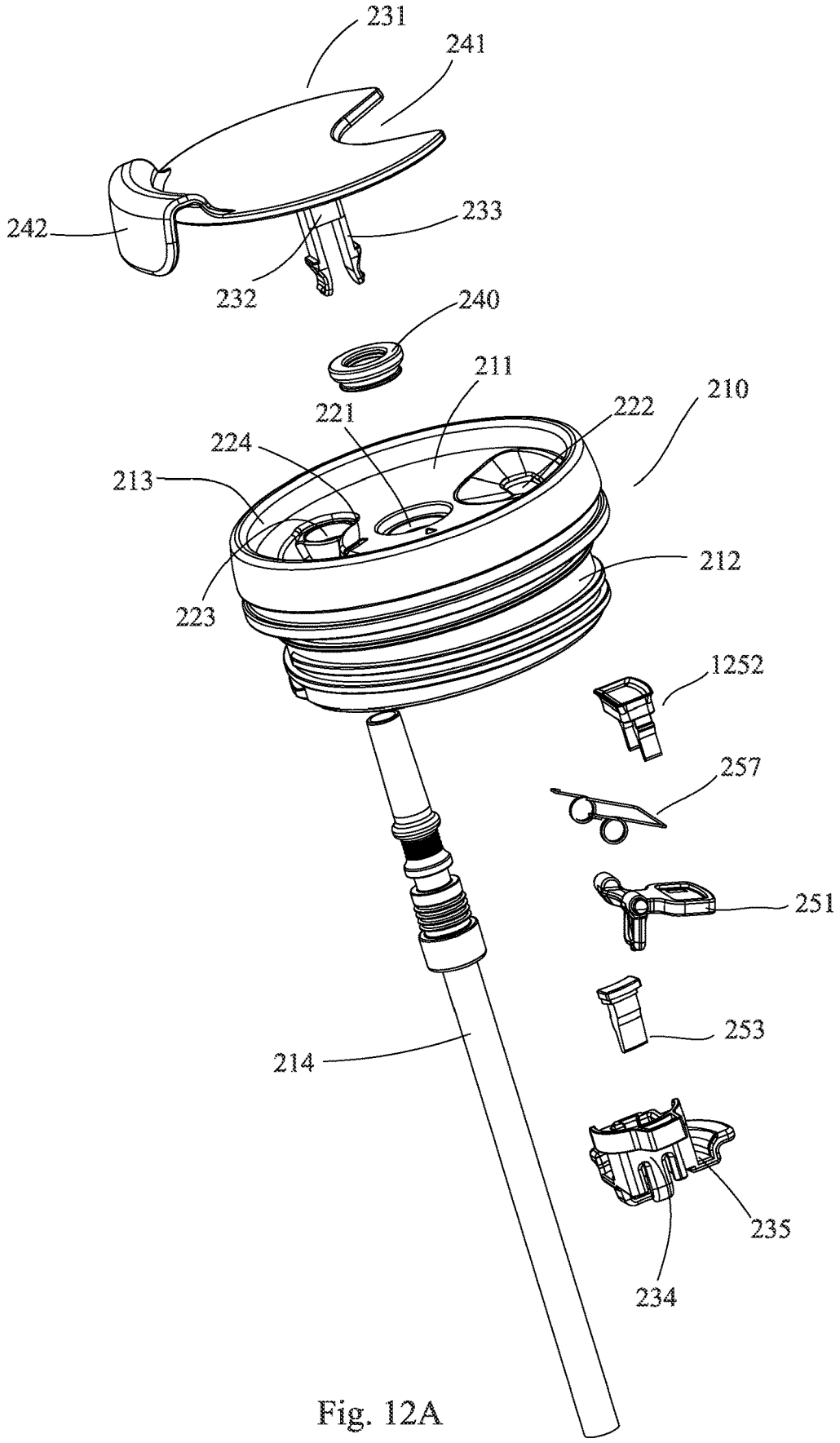
FIG. 12A is a perspective view of the lid assembly shown in FIG. 11 with the drinking straw ready for dispensing of beverage.
Figure 12B:
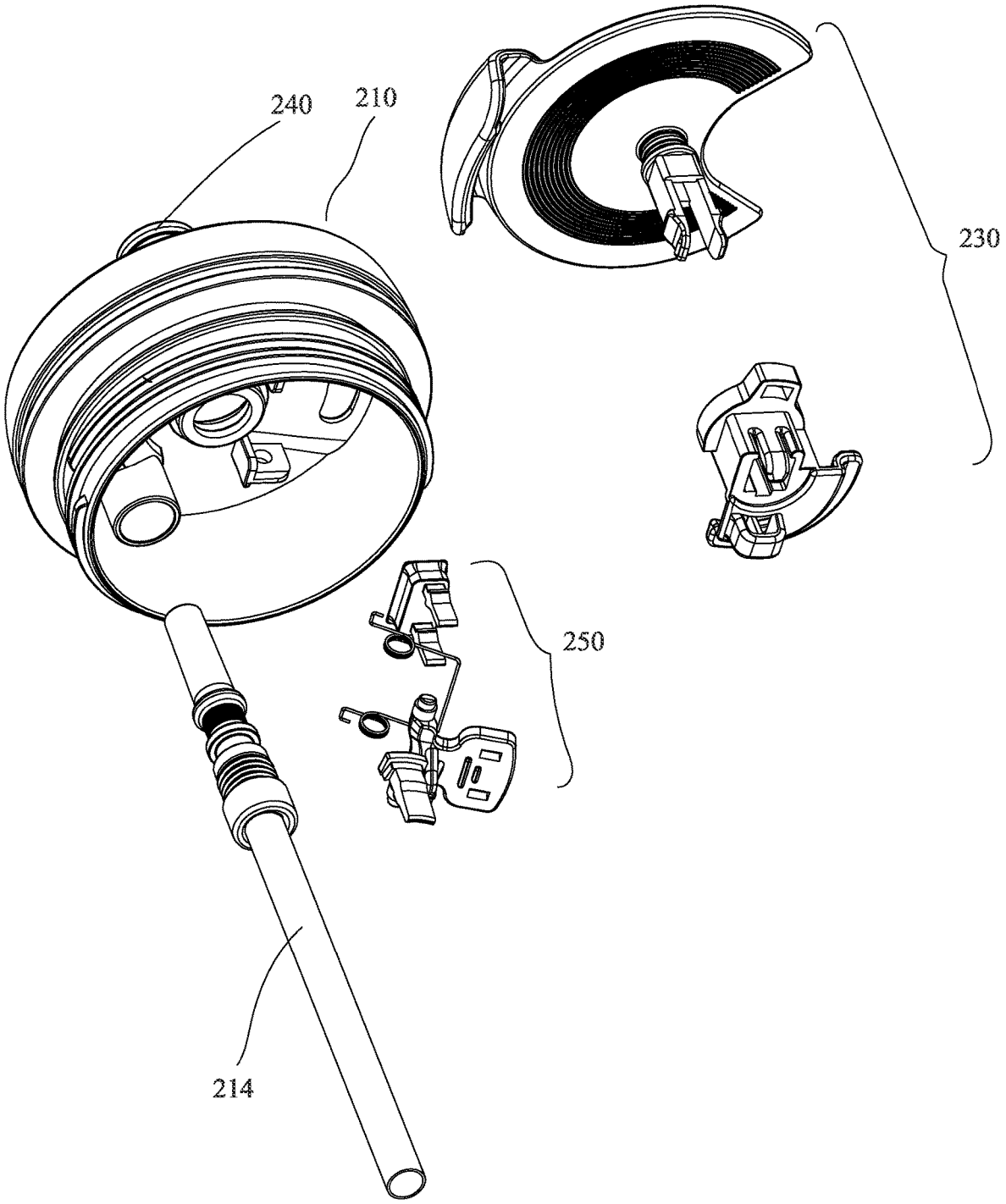
FIG. 12B is a perspective view of the lid assembly of FIG. 12A, with the top plate and the drinking straw removed.
Figure 13A:
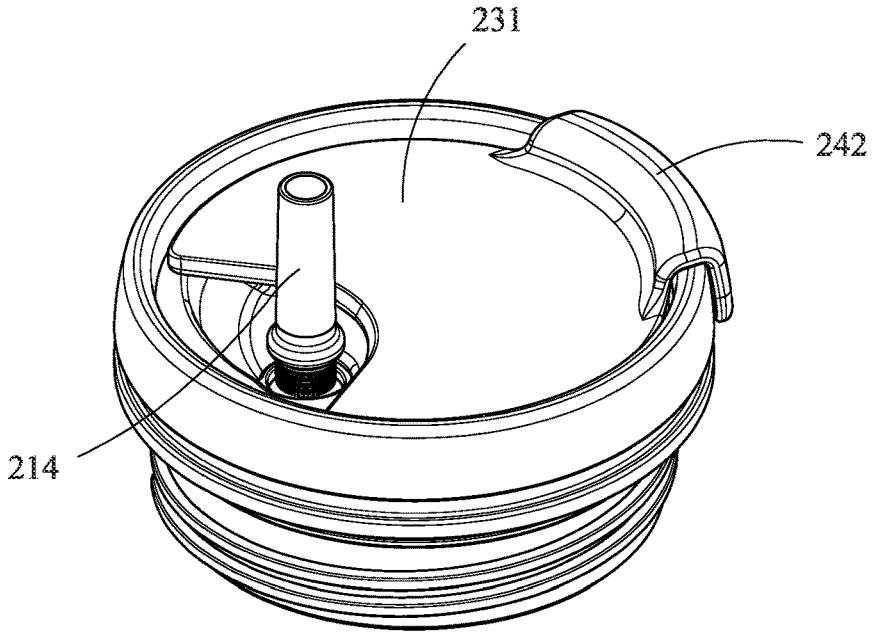
FIGS. 13A and 13B are perspective exploded views of the lid assembly shown in FIG. 11 in two different angles of view.
Figure 13B:
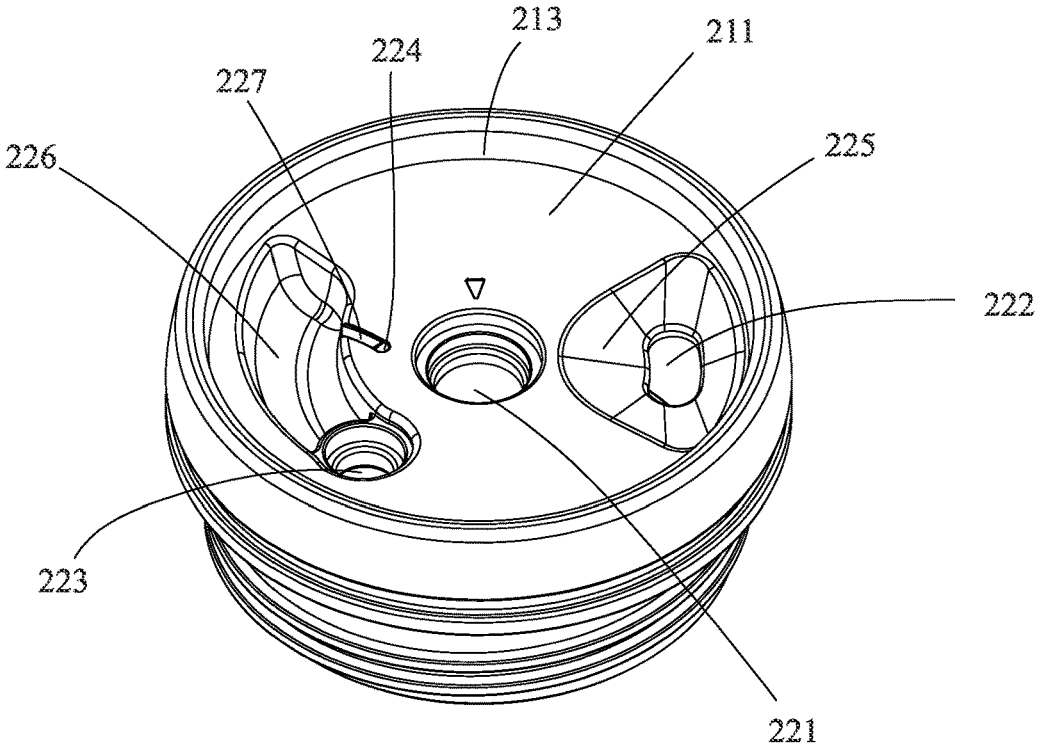

As shown in FIGS. 15A to 15D further with reference to FIGS. 12A and 12B, the trigger mechanism 230 is rotatably mounted on the lid cover 211, and comprises a rotary top plate 231, a rotary shaft 232 integral with the top plate 231 and extending downwardly from an underside of the top plate, two spaced-apart press-fit legs 233 extending downwardly from end face of the rotary shaft 232 at a center thereof, and a guide arrangement. The rotary top plate 231 is configured to have a substantially V-shaped cutout 241 and a handle 242 projecting from an upper surface of the top plate 231 and rotatably fitting onto the raised rim 213 of the lid cover 211. The two spaced-apart press-fit legs 233 are adapted for rotatably passing through the central through hole 221 of the lid cover 211. Each of the two press-fit legs 233 includes a stop portion 2331 at its free end. The guide arrangement comprises a bushing 234 with two open ends and a guide rail 235 extending transversely from a lower section of the bushing 234. The two press-fit legs 233 are insertable into the bushing 234 and press against the inner wall of the bushing 234 so that the press-fit legs are secured to the bushing 234. The stop portions 2331 of the press-fit legs 233 are located exterior of the bushing 234 and are in abutment with a bottom end face of the bushing 234 in order to enhance the coupling therebetween. Because the press-fit legs 233 are secured to the bushing 234, turning the handle 242 of the top plate 231 would drive the bushing 234 and thus the guide rail 235 to rotate at the same time.

Figure 16A:
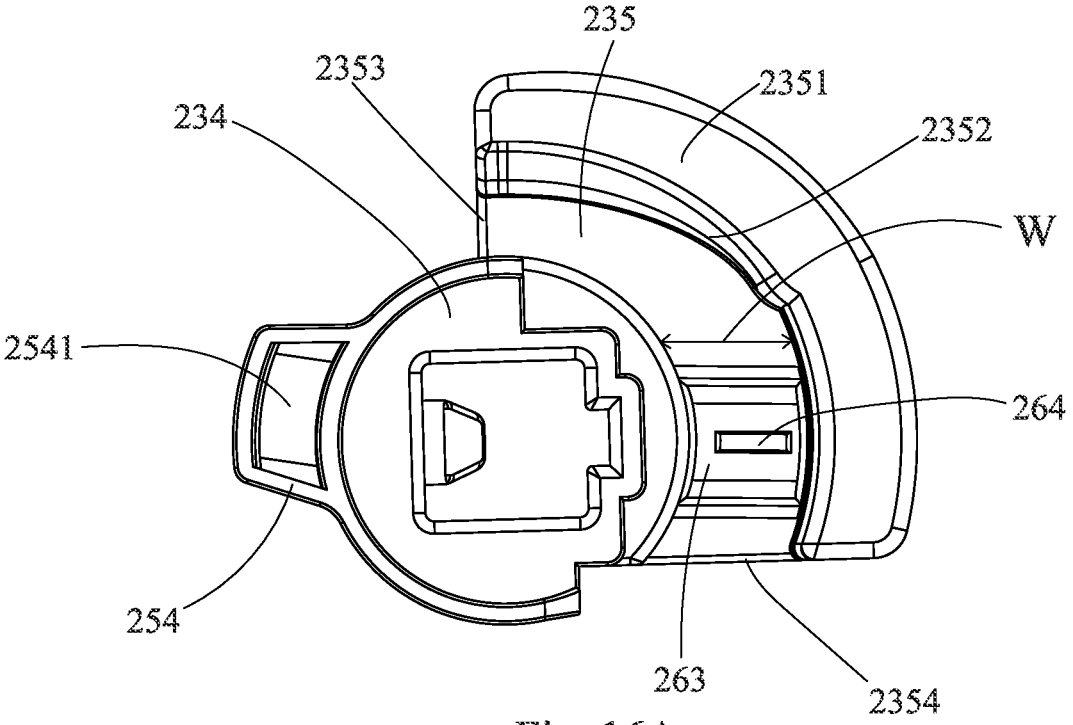
FIGS. 16A and 16B are top elevation view and perspective view of the guiding arrangement of the lid assembly shown in FIG. 11, respectively.
Figure 16B:
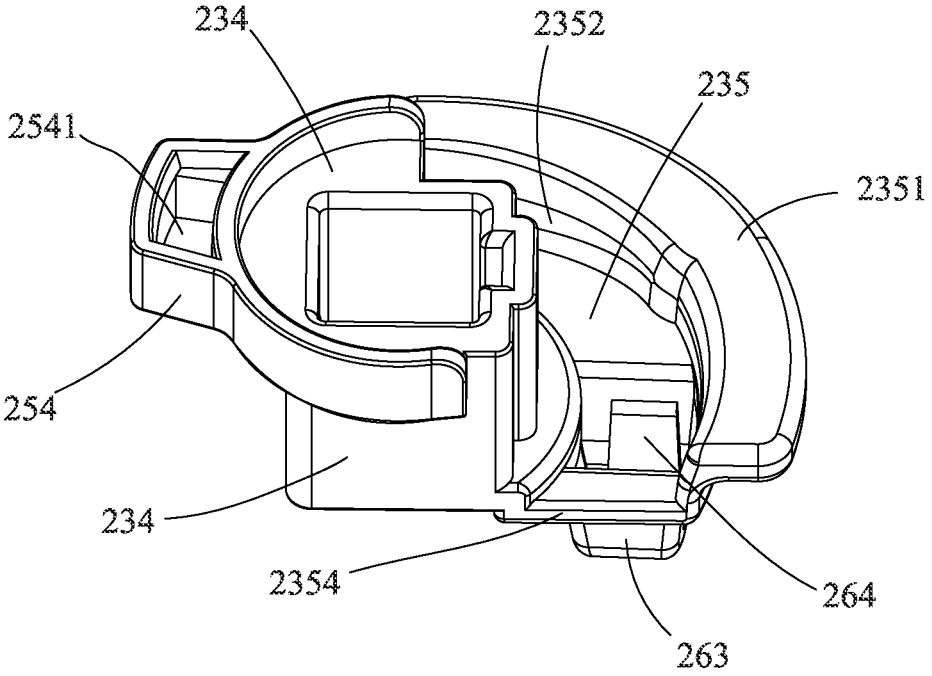
Figure 17:
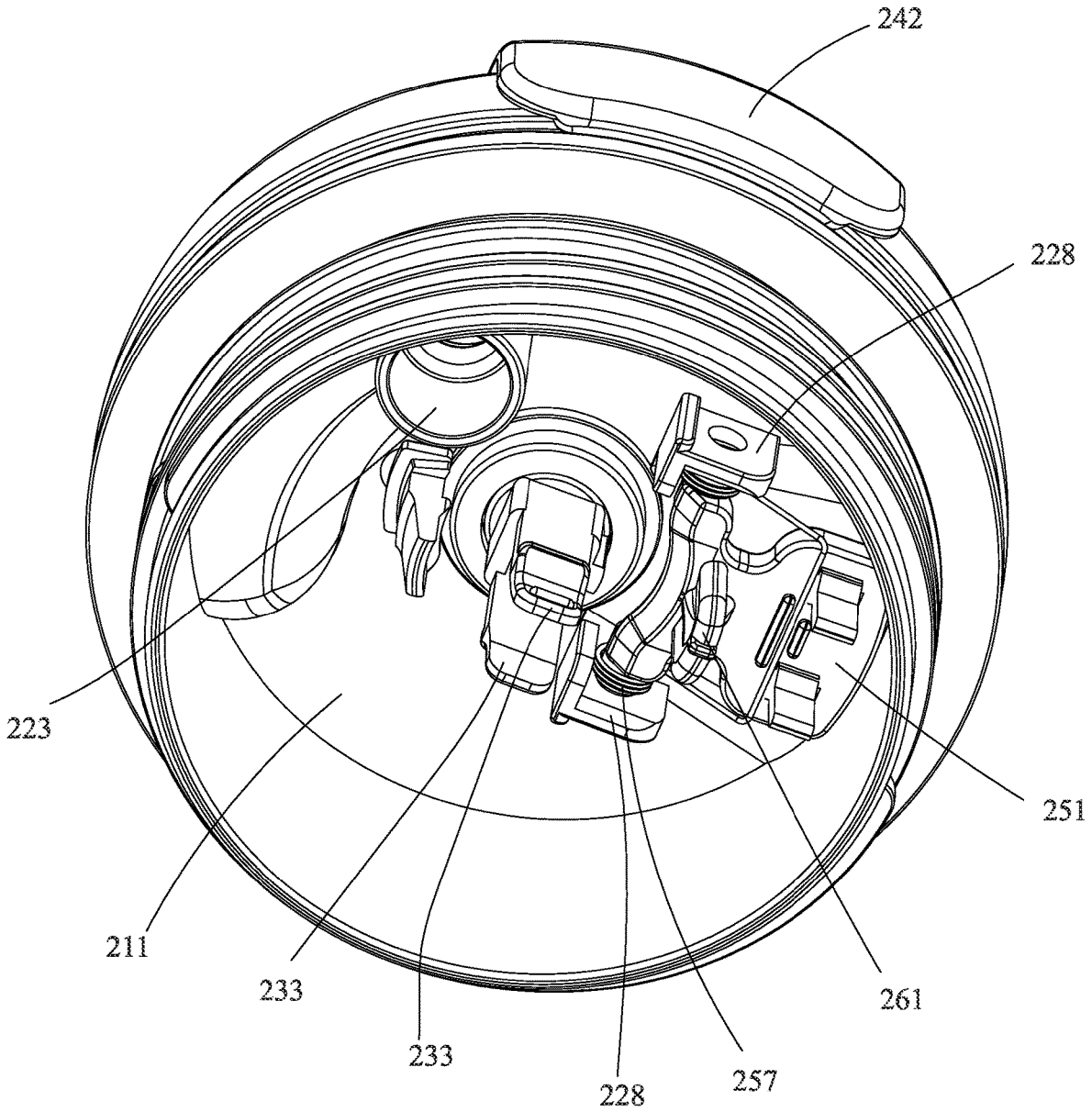
FIG. 17 is a perspective bottom view of the lid cover shown in FIG. 11, with a seal assembly pivotally mounted on the lid cover.
Figure 18A:
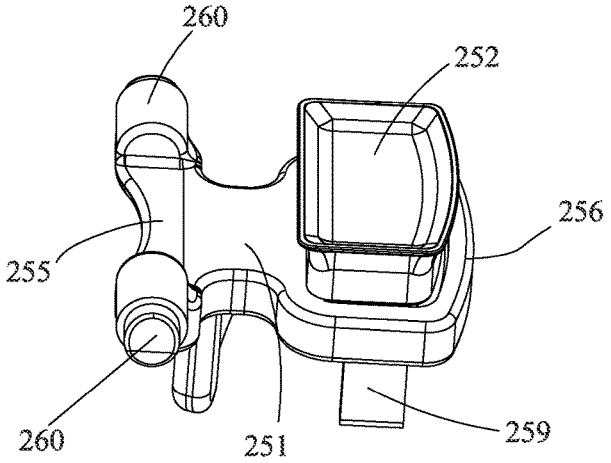
FIGS. 18A and 18B are perspective top and bottom views of the seal assembly shown in FIGS. 15A to 15D.
Figure 18B:
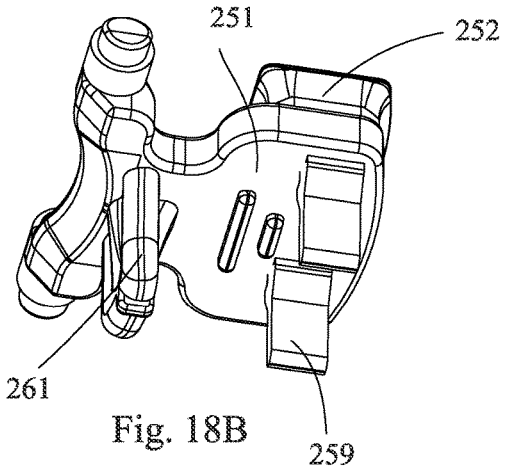
Figure 18C:
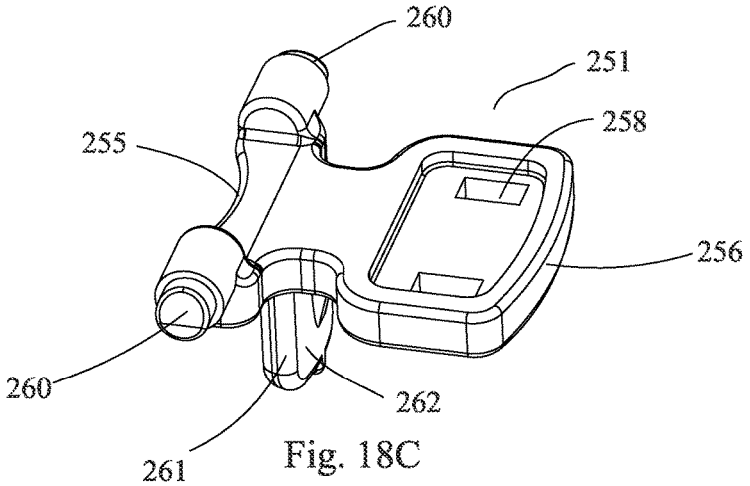
FIG. 18C is an exploded perspective view of a pivotal arm of the seal assembly shown in FIGS. 18A and 18B.
Figure 18D:
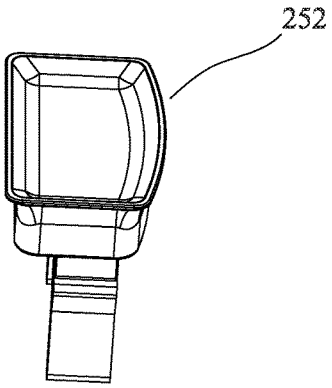
FIGS. 18D and 18E respectively show perspective views of second drink seal and vent seal of the lid assembly shown in FIGS. 18A and 18B.
Figure 18E:
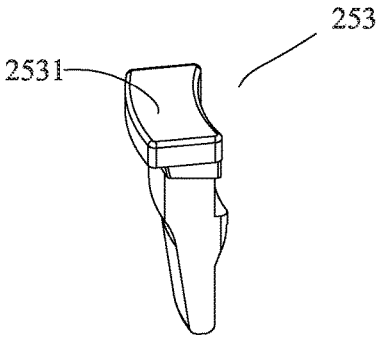
Figure 19A:
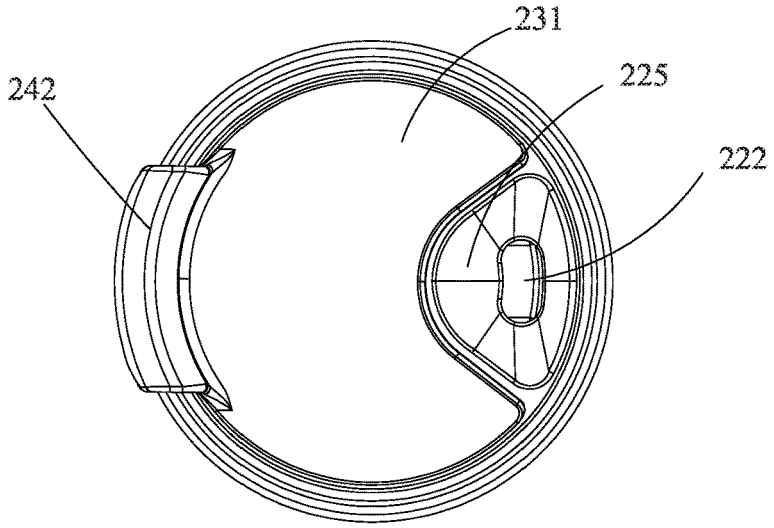
FIGS. 19A to 19C respectively show a top view, a bottom view and a cross-sectional view of the lid assembly shown in FIG. 11 in a first dispensing position where the first drink orifice is in fully open position, and the second drink orifice is fully closed.
Figure 19B:
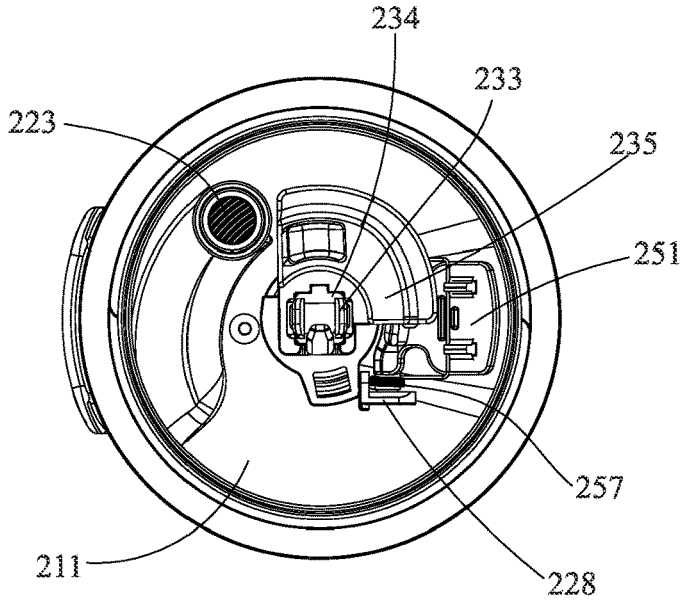
Figure 19C:
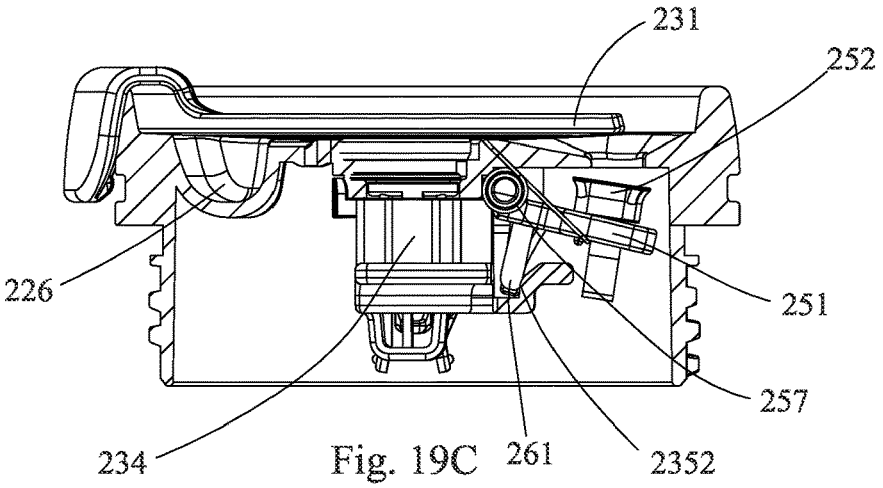

As shown in FIGS. 16A and 16B, the guide rail 233 is a substantially 90 degree fan-shaped sector and extends perimetrically from the bottom end of the bushing 234. The cross section of the guide rail 235 has normally the form of a letter U having a distal side branch 2351 located away from the bushing 234. The inner wall surface of the distal side branch 2351 of the letter U forms a guiding surface 2352 for the seal assembly 250, which will be discussed herein below. The guide rail 235 extends from a first end 2353 to a second end 2354. One of the features of the guide rail 235 is that the guide rail 235 may have a gradually variable guide width from the first end 2353 to the second end 2354 of the guide rail 235. In the illustrated embodiment of the invention, the guide rail 235 has a gradually increased width W starting from the first end 2353 to a depression 263 arranged in the vicinity of the second end 2354, then the width is kept constant until the second end 2354.

Figure 24:
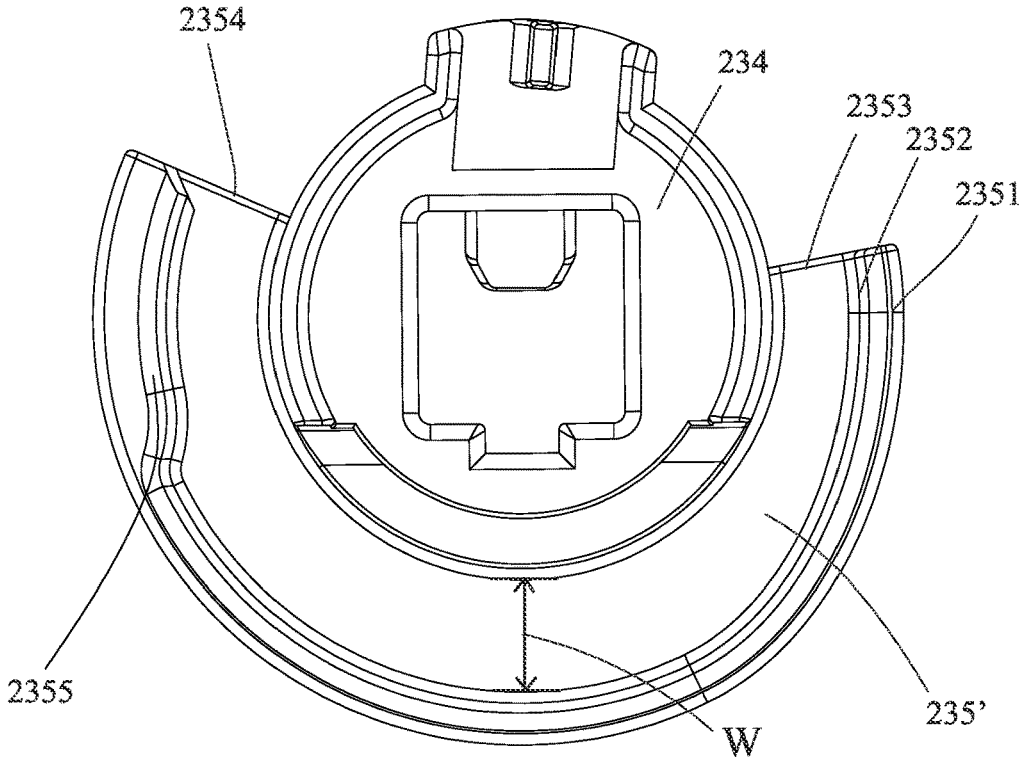
FIG. 24 is a top view of a variation of the guide rail of the trigger mechanism.

Alternatively, the guide rail 235' may have a substantially C-shape and have a constant guide width W over the entire length from the first end 2353 to the second end 2354, with one or more protrusions 2355 formed on the guiding surface 2352 in spaced apart fashion, which can serve the same purpose of the variable guide width W. In the guide rail 235' shown in FIG. 24, an elongated protrusion 2355 is formed on the inner wall surface of the distal side branch 2351 in the vicinity of the second end 2354.

Figure 25:
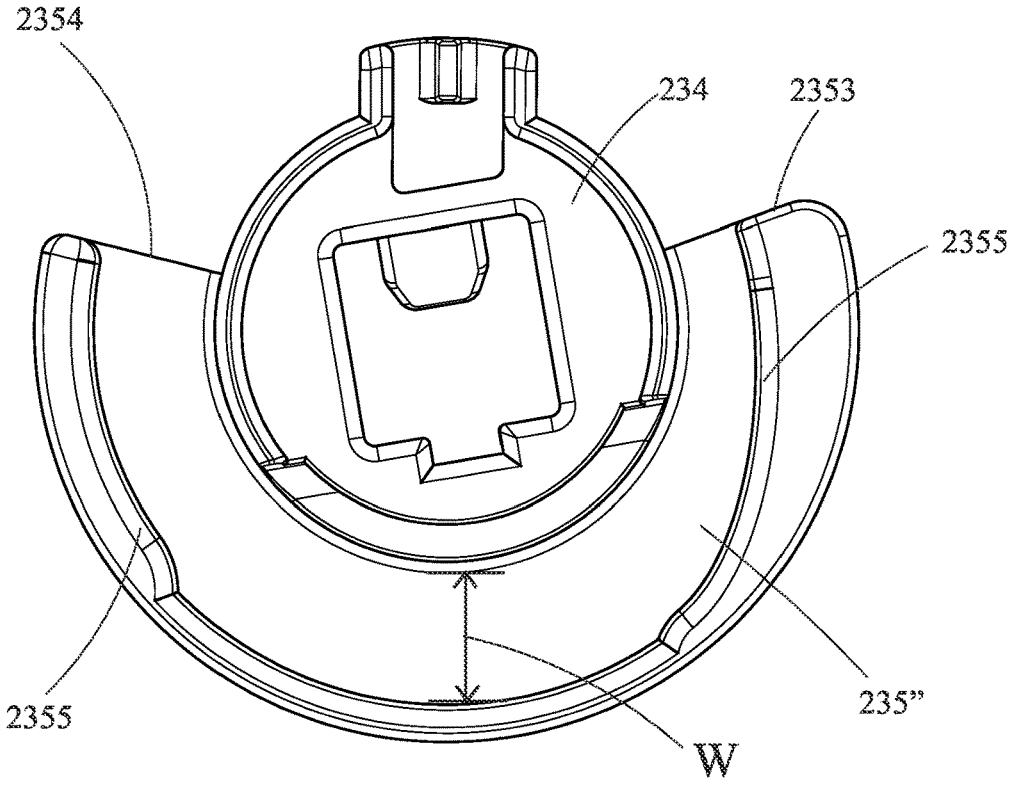
FIG. 25 is a top view of another variation of the guide rail of the trigger mechanism.

Another variation of the guide rail 235" is shown in FIG. 25, which differs from the guide rail discussed 235' above in its first segment starting from the first end 2353. A protrusion 2355 extends laterally from the guiding surface 2352, with the lateral extension of gradually reduced length starting from the first end 2353 along the peripheral direction of the distal side branch of the guide rail 235". The guide width W of the guide rail 235" is gradually increased along with said lateral extension of gradually reduced dimension.

The seal assembly 250 is provided beneath the lid cover 211. With reference to FIG. 17 and FIGS. 18A to 18E, the seal assembly 250 is pivotally mounted on the lid cover 211 to the pivots 228. The seal assembly 250 comprises a pivotal arm 251 which pivots about the pivots 228, a drink seal 252 mounted on the pivotal arm 251 adapted for closing the first drink orifice 222, and a vent seal 253 held on a seal holder 254 provided on an outer side wall of the bushing 234 for closing the gas vent 224. The pivotal arm 251 and the seal holder 254 are arranged on opposite side of the bushing 234. As shown in FIG. 16B, the seal holder 254 has a receiving slot 2541 through which the gas seal 253 passes with its head 2531 located exterior of the receiving slot 2541 to sealably close the gas vent 224 in the closed position of the gas vent 224. When the rotary top plate 231 is turned in clockwise or anticlockwise direction, the bushing 234 and thus the gas seal 253 is driven by the top plate 231 to move away from the gas vent 224, thereby allow the gas contained in the mug 2 to escape through the gas vent 224 to the external environment of the mug 2.

Specifically, the pivotal arm 251 has a proximal end 255 and a distal end 256, and is pivotally mounted on the underside of the lid cover 211 by inserting two stubs 260 extending from opposite sides of the proximal end 255 into respective holes of the pivots 228. A torsion spring 257 is held on each of the stubs 260 to constantly apply an upward pressure to the pivotal arm 251. The pivotal arm 251 further includes two slots 258 arranged between the proximal end 255 and the distal end 256. The drink seal 252 has two inserts 259 that are positioned for snug insertion into the slots 258 of the pivotal arm 251 and being fixed in place, so that the drink seal 252 can move pivotally along with the pivotal movement of the pivotal arm 251. The vent seal 253 is positioned and configured to be engageable sealably with the gas vent 224, and the drink seal 252 is positioned and configured to sealably block the first drink orifice 222 when the lid assembly is in the fully closed positioned.

The seal assembly 250 further comprises a guide pin 261 extending downwardly from the proximal end 255 of the pivotal arm 251. The guide pin 261 is positioned and configured to cooperate with the guide rail 235. As shown in FIGS. 15A to 15D, the guide pin 261 is positioned to enter and be received in the guide rail 235 along with the turning of the guide rail 235 with respect to a longitudinal axis of the lid assembly 200. The side wall 262 of the guide pin 261, which is facing toward the distal end 256 of the pivotal arm 251, is alternately unconstrained to the guiding surface 2352 of the guide rail 235, and in abutment with the guiding surface 2352 of the designated segments of the guide rail 235 as discussed below. During the rotation process of the guide rail 235 driven by turning the rotary top plate 231, the side wall 262 of the guide pin 261 located within the guide rail 235 would set against the guiding surface 2352 of the guide rail 235 at positions of reduced rail width or set against the protrusion 2355, so that the guide pin 261 is pressed inwardly by the distal side wall 2351 of the guide rail 235 to pivot the pivotal arm 251 with the drink seal 252 carried thereon downwardly, thereby to drive the movement of the drink seal 252 away from the first drink orifice 222. In this way the first drink orifice 222, which is blocked by the drink seal 252, is opened by turning the top plate 231, allowing for dispensing of the beverage from the first drink orifice 222. As described above, the gas vent 224 is also closed by the vent seal 253, and therefore would be opened due to its rotation along with the rotational movement of the bushing 234. This would create a venting space to allow the gas within the container to come out of the lid assembly 200.

FIGS. 26A to 26C illustrate a seal assembly constructed according to another preferred embodiment of the invention. The seal assembly in this embodiment has the substantially same structure as the seal assembly 250 discussed above, but differs from the seal assembly 250 in that the drink seal 252' and the vent seal 253' are provided separately but are carried on the pivotal arm 251'. Each of the drink seal 252' and the vent seal 253' are respectively provided with inserts 259' and 259" which are insertable to respective slots 258' and 258" formed through the pivotal arm 251'. This design of the seal assembly is adapted for the gas vent arranged on the same side of the first drink orifice 222.

Figure 20A:
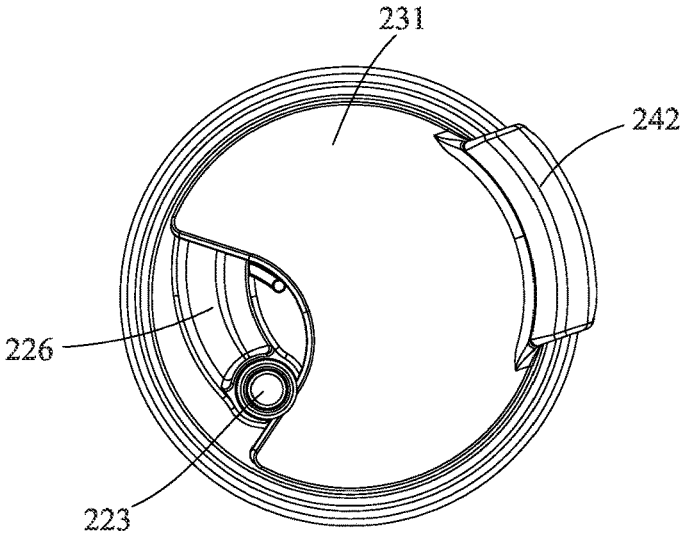
FIGS. 20A to 20C respectively a top view, a bottom view and a cross-sectional view of the lid assembly shown in FIG. 11 in a second dispensing position, where the second drink orifice is in fully open position with the drinking straw ready for dispensing the beverage, and the first drink orifice is fully closed.
Figure 20B:
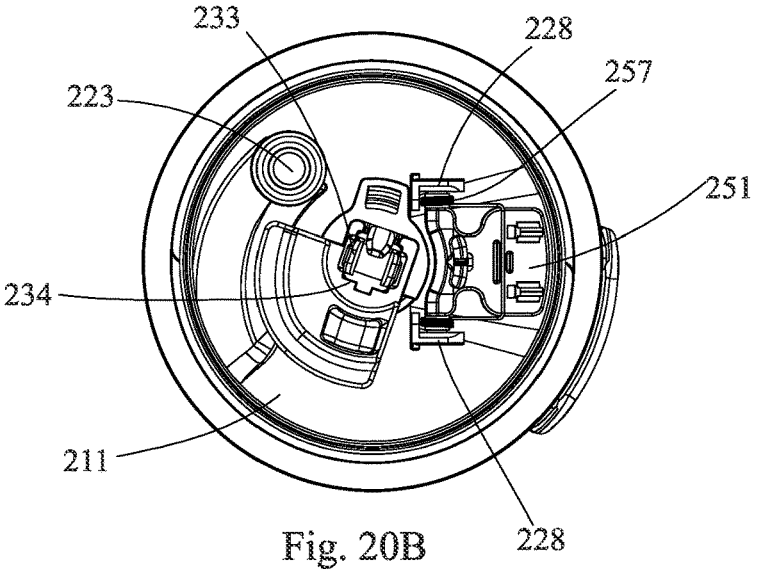
Figure 20C:
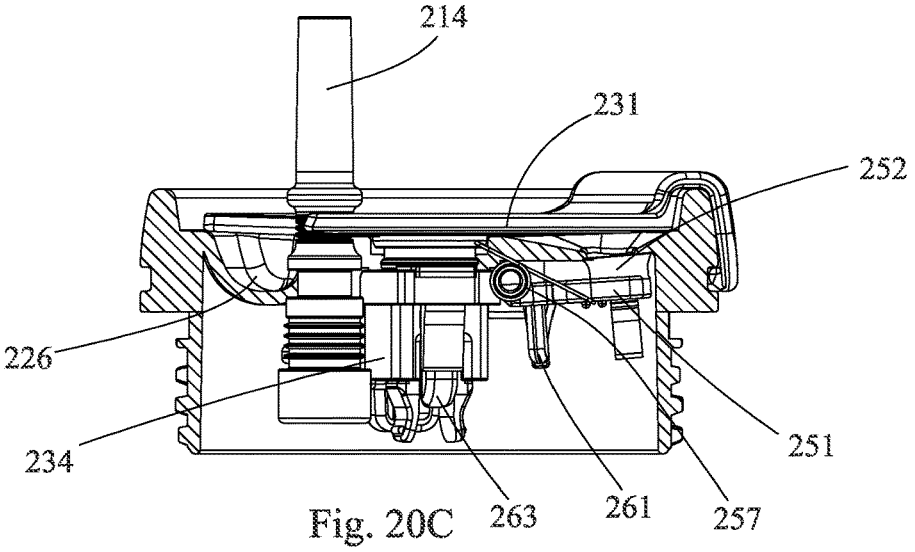
Figure 21A:
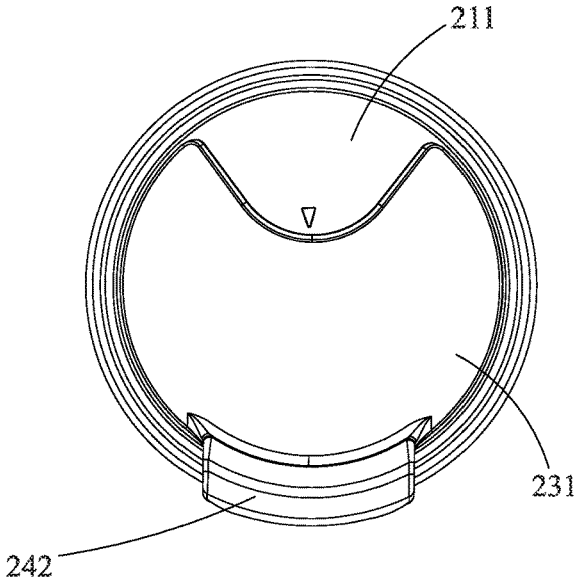
FIGS. 21A to 21C respectively show a top view, a bottom view and a perspective view of the lid assembly in a third fully closed position, where both the first and second drink orifices are fully closed.
Figure 21B:
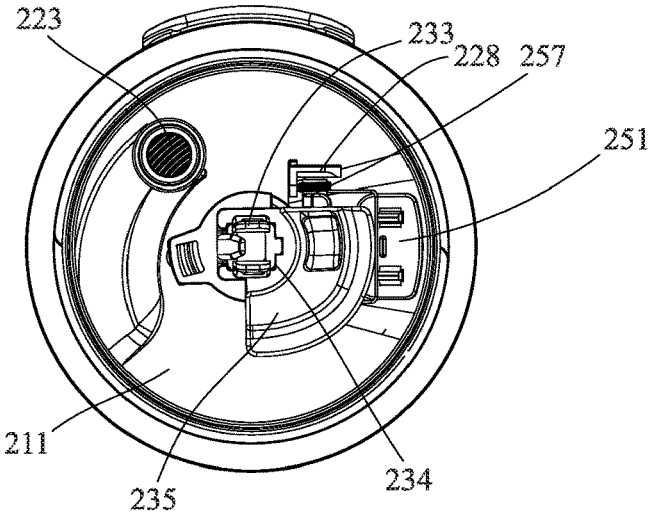
Figure 21C:
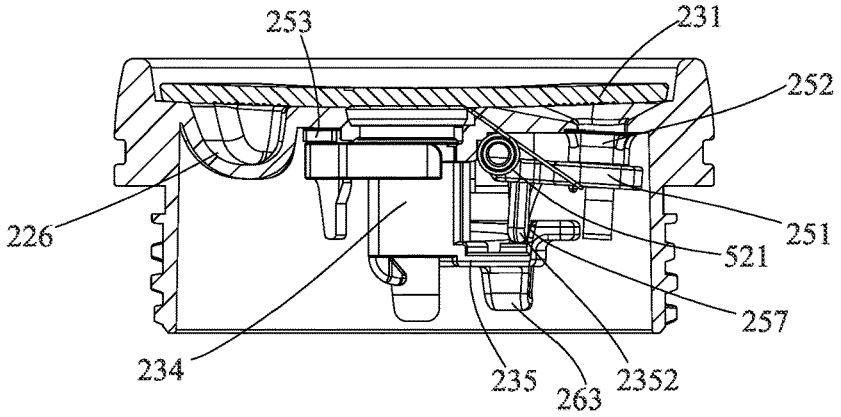
Figure 22A:
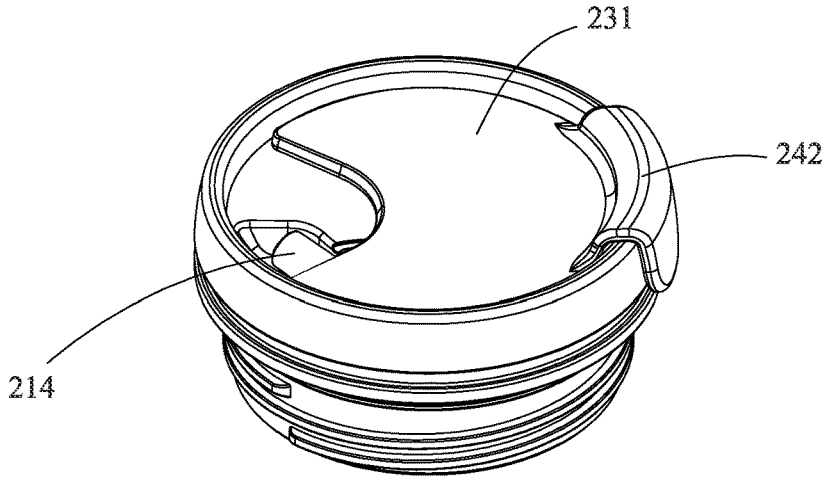
FIGS. 22A to 22C are perspective views of the lid assembly shown in FIG. 11, illustrating the folding movement of the drinking straw from a folded, closed position to an unfolded, open position.
Figure 22B:
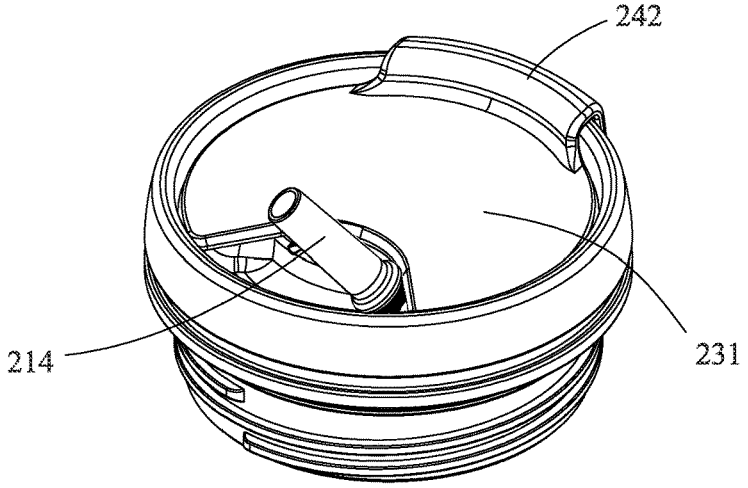
Figure 22C:
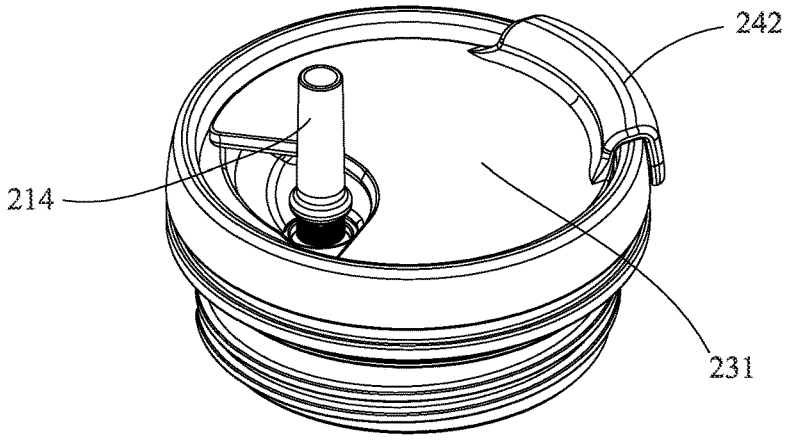
Figure 23:
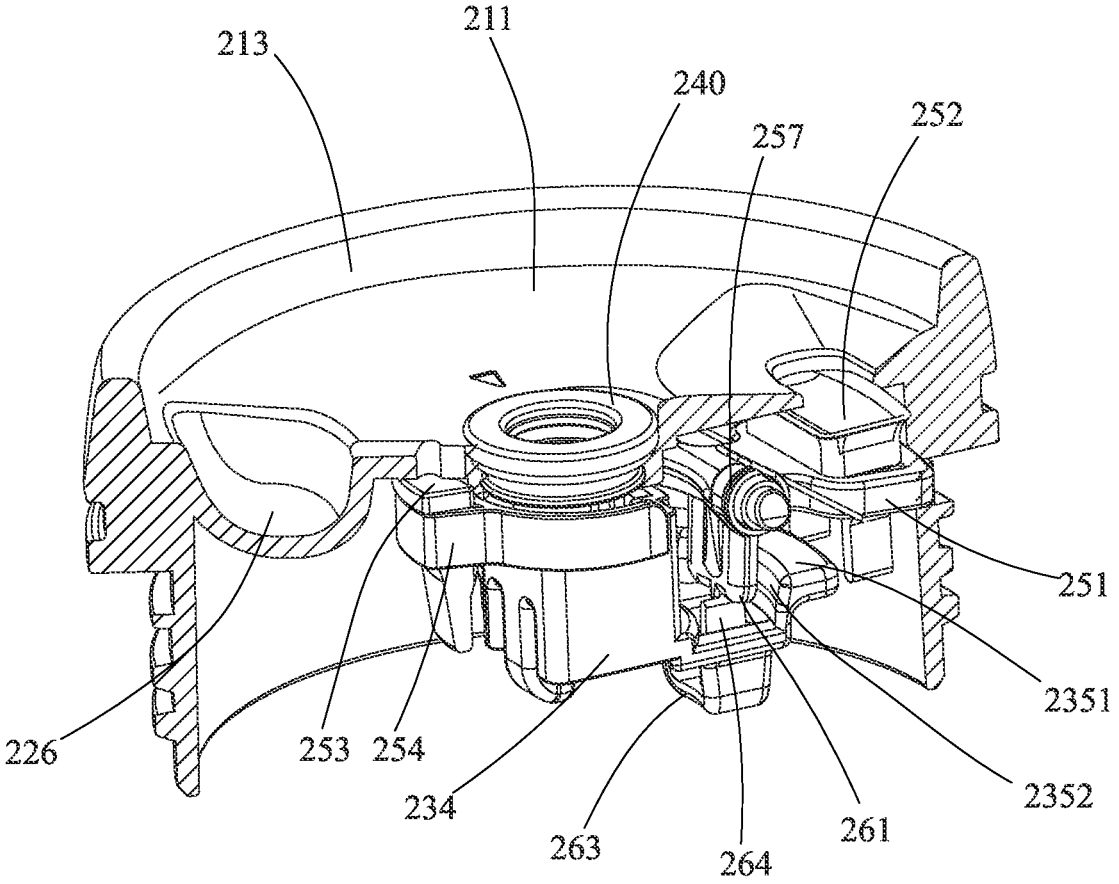
FIG. 23 is a perspective top view of the lid assembly in the third fully closed position, taken along a diametric axis Y.

FIGS. 19A to 21C are schematic views of the top plate 231 in different positions. When the top plate 231 is in the fully closed position as shown in FIGS. 21A to 21C, the cutout 241 of the rotary top plate 231 is misaligned with any of three of the first drink orifice 222, the second drink orifice 223 and the gas vent 224, so that all the three orifices are fully covered up by the rotary top plate 231, the beverage in the mug 2 cannot be dispensed, which is clearly shown in FIG. 21A. In this position, the first drink orifice 222 and the gas vent 224 are sealably blocked by the drink seal 252 and the vent seal 253; and the top segment of the drinking straw 214 running through and protruding beyond the second drink orifice 223 is folded down to lie within the recessed portion 226, which therefore blocks passage of the beverage through the drinking straw 214. A tab 264 extending upwardly from the depression 263 in the vicinity of the second end 2354 is in abutment with a free end of the guide pin 261, as shown in FIG. 23.

As described above, the rotary top plate 231 is rotatably placed on the lid cover 211 around the central longitudinal axis of the lid cover 211, and turning the handle 242 can drive the guide rail 235 to override the tab 264 and simultaneously rotate about the central longitudinal axis of the lid cover 211, with the result that the vent seal 253 is caused to rotate away from the gas vent 224 to allowing for the escape of gas in the mug 2, and at the same time the guide pin 261 is pressed inwardly by the guiding surface 2352 of the guide rail 235 to pivot the pivotal arm 251 carrying the drink seal 252 downwardly away from the first drink orifice 222. Turning in a clockwise direction the top plate 231 in fully closed position can drive the clockwise rotation of the guide rail 235, so that the guiding surface 2352 of gradually reduced rail width W moves to come into contact with the side wall 262 of the guide pin 261 and forces the guide pin 261 to move inwardly. The guiding surface 2352 continues to rotate until the first end 2353 of the smallest guide width comes into contact with the side wall 262 of the guide pin 261 (see FIGS. 19B and 19C). During the rotation process, the reduced guide rail width would lead the guide pin 261 to further inward movement, which in turn enables the drink seal 252 to move down further away from the first drink 222, until the guide rail 235 encounters the drinking straw 214 which prevents the guide rail 235 from rotating further. At this point, the rotary top plate 231 is turned to its first fully open position where the cutout 241 is in alignment with the first drink orifice 222 but the drinking straw 214 still remains lying within the recessed portion 226 and being fully covered up by the top plate 231 (see FIG. 19A). In this position, the first drink orifice 222 is fully open and in fluid communication with the beverage in the mug 2 to allow for dispensing of the beverage therethrough.

If it is desirable for dispensing the beverage though the drinking straw 214, turning in an anticlockwise direction the top plate 231 in fully closed position (e.g. in the position shown in FIG. 21A) can drive the anticlockwise rotation of the guide rail 235, so that the guide rail 235 rotates to disengage from the guide pin 261 i.e. the guide pin 261 is not located within the guide rail 235. In other words, the guide pin 261 is not constrained to the guiding surface 2352 of the guide rail 235, and as a result, the pivotal arm 251 with the drink seal 252 would be forced to pivot upwardly under the action of the torsion spring 257 to sealably close the first drink orifice 222 (see FIGS. 20A to 20C). During the rotation process of the top plate 231, the cutout 241 rotates to partially overlie the recessed portion 226 of the lid cover 211 to have the drinking straw 214 be partially exposed (see FIG. 22A). This partially exposed drinking straw is ready for folding upwardly due to its material elasticity. The top plate 231 continues to rotate and the drinking straw 214 starts to fold upwardly (see FIG. 22B), until the rotary top plate 231 is turned to its second fully open position (see FIG. 22C). With the rotation of the bushing 234, the vent seal 253 would be caused to move away from the gas vent 224 to allow for the gas outflow through the gas channel 227. With reference to FIG. 20A, the cutout 241 is in alignment with the recessed portion 226 and the second drink orifice 223. The second drink orifice 223 is fully exposed, and the drinking straw 214 elastically folds upwardly to an upstanding position (see FIGS. 20C and 22C). Therefore, in the second fully open position of the top plate 231, the first drink orifice 222 is fully closed by the drink seal 252 and also covered up by the top plate 231 (see FIG. 20B), but the second drink orifice 223 is fully open, and the drinking straw 214 running through the second drink orifice 223 is in the upstanding position to be in fluid communication with the beverage in the mug to allow for dispensing of the beverage therethrough.

Figure 27:
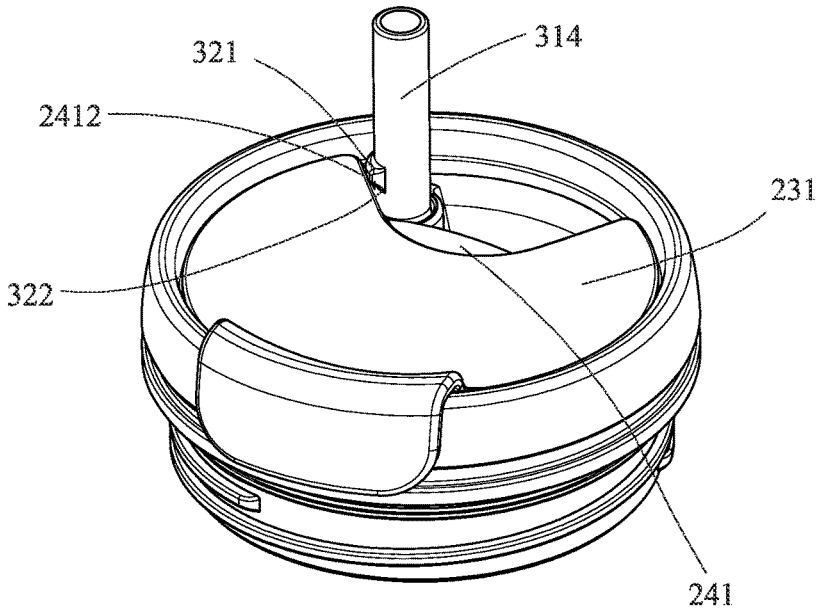
FIGS. 27 to 29 show in schematic views the process of a drinking straw folding downwardly from its upstanding position to its folded position constructed according to a preferred embodiment of the invention.
Figure 28:
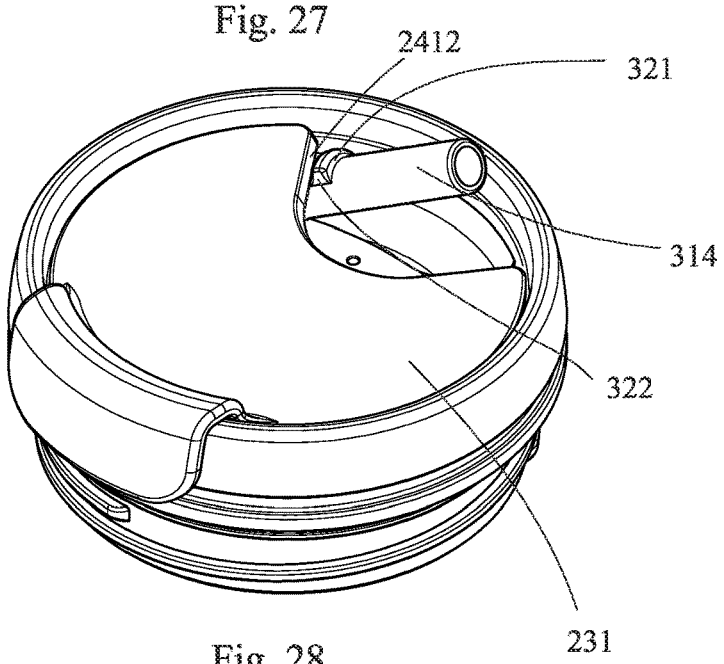
Figure 29:
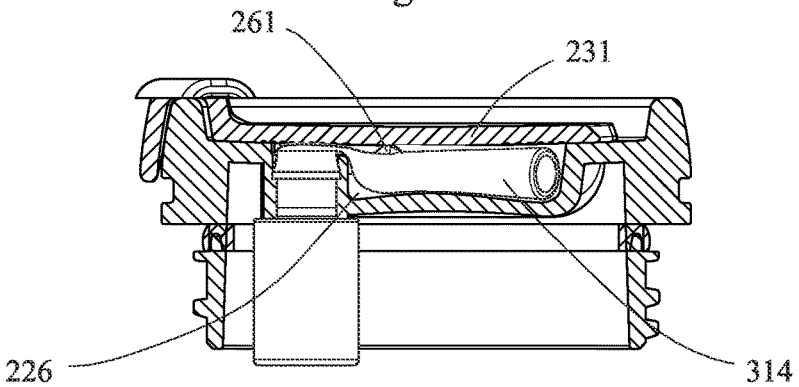

FIGS. 27 to 29 illustrate a drinking straw 314 constructed consistent with a preferred embodiment of the invention. In this embodiment, the drinking straw 314 has a bulge 321 formed on a wall surface of the drinking straw 314 so that the edge 2412 of the V-shaped cutout 241 sets against the bulge 321, and finally the rotary top plate 231 overrides the bulge 321 to overlie the drinking straw 314 during the rotation of the rotary top plate 231 from the open position to the closed position of the second drink orifice 223. In these figures, there is illustrated the process of the drinking straw 314 folding downwardly from its upstanding position (FIG. 27) to its folded position (FIG. 29) where the top segment of the drinking straw 314 fully lies within the recessed portion 226. The drinking straw 314 shown in FIG. 27 is in the upstanding position ready for dispensing of the beverage, with the bulge 321 is facing but remains non-contact with the contiguous edge 2412 of the V-shaped cutout 241. When the rotary top plate 231 is caused to perform a clockwise turning, the contiguous edge 2412 of the V-shaped cutout 241 turns to come into contact with the bulge 321 and gradually presses against an inclined side face 322 of the bulge 321 to urge folding of the drinking straw 314 downwardly farther than the drinking straw 214 of the above embodiments. As shown in FIG. 29, the drinking straw 314 is pressed by the top plate 231 to lie in the recessed portion 226 at a lower position, so as to provide a much better sealing function because the tendency for the beverage to squirt or spill from the drinking straw 314 is better blocked.

Thus the present invention provides a lid assembly characterized by having a rotary trigger mechanism useful to open and close the drink orifices and gas vent, and is also able to selectively open the type of drink orifice as desirable. Another advantage of the trigger mechanism is that it ensures the user to open the gas vent before opening the drink orifices to dispense the beverage contained in the mug during the process of opening the drink orifices.

While the above described are preferred embodiments of The lid assembly of the present invention with what is presently considered to be the most practical and preferred arrangement, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

What is claimed is:

1. A lid assembly for a beverage container, comprising:

a lid comprising a lid cover at least having a first drink orifice and a second drink orifice extending therethrough, and a side wall extending downwardly from the lid cover, and a trigger mechanism, comprising a bushing, is for selectively opening and closing the first and second orifices, comprising a top plate rotatably placed on the lid cover and having a cutout, and a trigger which is operably coupled to the top plate to cause the top plate to rotate about a longitudinal axis of the lid at least among a first position where the cutout of the top plate aligns with the first drink orifice to expose the first drink orifice and the second drink orifice is closed by the top plate, a second position where the cutout of the top plate aligns with the second drink orifice to expose the second drink orifice and the first drink orifice is closed by the top plate, and a third position where the cutout of the top plate misaligns with both the first and second drink orifices to close the two drink orifices, a seal assembly is provided to sealably close the drink orifice and the gas vent, having a rotatable arm extending laterally from the bushing, characterized in that, first and second rotation stoppers are formed at an angular distance on a bottom surface of the lid cover to limit an angle of the rotation of the rotatable arm, and the first and second rotation stoppers correspond to the first and second positions of the top plate.

2. The lid assembly of claim 1, wherein the lid cover includes a recessed portion formed in a top surface thereof and positioned contiguous to the second drink orifice, the recessed portion being adapted to receive a top segment of a foldable drinking straw which passes through the second drink orifice, the top segment being constrained by the top plate in the recessed portion when the top plate is in the second and third positions, and caused to elastically folds upwards when the top plate is in the first position.

3. The lid assembly of claim 2, wherein the lid cover further defines a gas vent in a sloping portion configured to slope downwards to the first drink orifice, and a central through hole, the gas vent and the central through hole being in alignment with the first drink orifice along a diametric axis of the lid cover; or the lid cover further defines a gas vent in fluid communication with the external environment through an airway defined in the lid cover.

4. The lid assembly of claim 3, wherein the top plate comprises a rotary shaft extending downwardly from an underside of the top plate, through which the top plate is rotatably mounted on the lid cover.

5. The lid assembly of claim 4, wherein the rotary shaft is terminated by two spaced-apart press-fit legs, a drink seal and a vent seal carried on the rotatable arm to respectively sealably close the first drink orifice and the gas vent, and wherein the press-fit legs are adapted for insertion into the bushing to press against an inner wall of the bushing to create a secure connection therebetween, so that the bushing with the seal assembly is driven to rotate by rotating the top plate.

6. The lid assembly of claim 1, wherein a fan-shaped boss is formed on the bottom surface of the lid cover between the first and second rotation stoppers and positioned to underlie the first drink orifice and the gas vent, and a projection is formed on the side wall of the lid and positioned vertically in correspondence with the boss; and wherein the drink seal and the vent seal are caused to biased against the lid cover to sealably engage with the second drink orifice and the gas vent respectively when the lateral arm is rotated to be held between the boss and the projection.

7. The lid assembly of claim 6, wherein the bushing further comprises a pin post formed on an opposite side of the bushing to the rotatable arm, and a tab is formed on the bottom surface of the lid cover and located in a rotation path of the pin post so as to limit the pin post to rotate when the lateral arm is rotated to be held between the boss and the projection, and application of force is required to enable the pin post to override the tab, thereby allowing the bushing to rotate.

8. A lid assembly for a beverage container, comprising:

a lid comprising a lid cover at least having a first drink orifice and a second drink orifice extending therethrough, and a side wall extending downwardly from the lid cover, and a trigger mechanism for selectively opening and closing the first and second orifices, comprising a top plate rotatably placed on the lid cover and having a cutout, the top plate comprises a rotary shaft extending downwardly from an underside of the top plate, through which the top plate is rotatably mounted on the lid cover, and a trigger which is operably coupled to the top plate to cause the top plate to rotate about a longitudinal axis of the lid at least among a first position where the cutout of the top plate aligns with the first drink orifice to expose the first drink orifice and the second drink orifice is closed by the top plate, a second position where the cutout of the top plate aligns with the second drink orifice to expose the second drink orifice and the first drink orifice is closed by the top plate, and a third position where the cutout of the top plate misaligns with both the first and second drink orifices to close the two drink orifices, wherein the rotary shaft is terminated by two spaced-apart press-fit legs, and the trigger mechanism comprises a guide arrangement which includes a bushing and a guide rail extending transversely from the bushing; wherein the lid assembly further comprises a seal assembly comprising a pivotal arm pivotally mounted on the lid cover, and a drink seal and a vent seal which are either carried on the pivotal arm or carried on a seal holder provided on an outer side wall of the bushing to respectively sealably close the first drink orifice and the gas vent; and the press-fit legs are adapted for insertion into the bushing to press against an inner wall of the bushing to create a secure connection therebetween, so that the bushing with the seal assembly is driven to rotate by rotating the top plate.

9. The lid assembly of claim 8, wherein the guide rail is configured to have a cross section in the form of a letter U having a distal side branch located away from the bushing and a proximal side branch proximate to the bushing, and the seal assembly further comprises a guide pin extending downwardly from the pivotal arm and positioned to enter and be received in the guide rail, and wherein the guide pin cooperates with the guide rail to actuate the pivotal arm to pivot upwardly and downwardly with respect to the lid cover to close or open the first drink orifice and/or the gas vent.

10. The lid assembly of claim 9, wherein the distal side branch of the guide rail has an inner wall surface that forms a guiding surface, and the guide pin has an outer side wall facing toward the guiding surface, wherein the guide pin is received in the guide rail in such a manner that, during rotation of the guide rail, the outer side wall of the guide pin is alternately unconstrained to the guiding surface of the guide rail, and in abutment with the guiding surface of the guide rail, thereby to actuate the upward and downward pivotal movement of the pivotal arm.

11. The lid assembly of claim 10, wherein the guide rail has a substantially arcuate shape extending from a first end to a second end, and wherein the guide rail has a constant guide width over an entire length from the first end to the second end, with one or more protrusions formed on the guiding surface, so that the outer side wall of the guide pin located within the guide rail sets against the protrusion, thereby the guide pin is pressed inwardly by the guiding surface to pivot the pivotal arm downwardly.

12. The lid assembly of claim 11, wherein the protrusion extends laterally from the guiding surface of the guide rail, with the lateral extension of gradually reduced dimension along the perimetric direction of the distal side branch, so as to provide the guide rail with a guide width of gradually increased along with said lateral extension of gradually reduced dimension.

13. The lid assembly of claim 10, the guide rail has a substantially arcuate shape extending from a first end to a second end, and wherein the guide rail has a gradually variable guide width over an entire length from the first end to the second end in one or more designated segments of the guide rail, so that the outer side wall of the guide pin located within the guide rail sets against the guiding surface of the guide rail at positions of reduced rail width, thereby the guide pin is pressed inwardly by the guiding surface to pivot the pivotal arm downwardly.

14. The lid assembly of claim 10, wherein the pivotal arm has a proximal end pivotally mounted on the lid cover through two stubs extending from opposite sides of the proximal end, and a distal end, and wherein a torsion spring is held on each of the stubs to constantly apply an upward pressure to the pivotal arm.

15. The lid assembly of claim 14, wherein the pivotal arm further includes one or more slots arranged between the proximal end and the distal end, and wherein the drink seal and the vent seal are provided with one or more inserts positioned for snug insertion into the slots of the pivotal arm and being fixed in place, so that the drink seal and the vent seal can move pivotally along with the pivotal movement of the pivotal arm.

16. The lid assembly of claim 9, wherein the guide rail comprises a tab which is limited to rotate by a tip portion of the guide pin when the seal assembly is in place to sealably close the lid cover, and application of force is required to enable the tab to override the tip portion of the guide pin, thereby allowing the guide rail to rotate.

17. The lid assembly of claim 8, wherein first and second rotation stoppers are formed at an angular distance on a bottom surface of the lid cover to limit an angle of the rotation of the guide rail, and the first and second rotation stoppers correspond to the first and second positions of the top plate, respectively.

18. The lid assembly of claim 1, wherein the lid cover has an annular raised rim that encircles the lid cover, and the trigger is provided as a handle projecting from an upper surface of the top plate and rotatably fitting onto the raised rim of the lid cover, so that turning the handle drives the top plate to move among the first, second and third positions.

19. The lid assembly of claim 2, wherein a bulge is formed on a wall surface of the drinking straw, the top plate is thus required to override the bulge to overlie the drinking straw during the rotation of the top plate to close the second drink orifice.

20. A beverage container comprising:

a container body including an open-top wall structure defining a receptacle for receiving beverage; and a lid assembly according to claim 1 or 8.

21. The lid assembly of claim 8, wherein the lid cover has an annular raised rim that encircles the lid cover, and the trigger is provided as a handle projecting from an upper surface of the top plate and rotatably fitting onto the raised rim of the lid cover, so that turning the handle drives the top plate to move among the first, second and third positions.

22. The lid assembly of claim 8, wherein the lid cover includes a recessed portion formed in a top surface thereof and positioned contiguous to the second drink orifice, the recessed portion being adapted to receive a top segment of a foldable drinking straw which passes through the second drink orifice, the top segment being constrained by the top plate in the recessed portion when the top plate is in the second and third positions, and caused to elastically folds upwards when the top plate is in the first position, wherein a bulge is formed on a wall surface of the drinking straw, the top plate is thus required to override the bulge to overlie the drinking straw during the rotation of the top plate to close the second drink orifice.

* * * * *